US006547534B1

(12) United States Patent
Sakamoto et al.

(10) Patent No.: US 6,547,534 B1
(45) Date of Patent: Apr. 15, 2003

(54) COMPRESSION APPARATUS

(75) Inventors: Yasuo Sakamoto, Gunma (JP); Hiroshi Nishikawa, Gunma (JP); Makoto Aida, Gunma (JP); Takahiro Nishikawa, Gunma (JP); Kazuya Sato, Gunma (JP); Takayuki Mizuno, Tochigi (JP); Aritomo Sato, Saitama (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/662,206

(22) Filed: Sep. 14, 2000

(30) Foreign Application Priority Data

Sep. 14, 1999 (JP) ..... 11-260439

(51) Int. Cl.[7] ..... F04B 25/00; F04B 3/00

(52) U.S. Cl. ..... 417/244; 417/266; 92/172; 92/60.5

(58) Field of Search ..... 417/244, 266, 417/273, 254, 245, 445, 446, 451, 456; 92/172, 162 R, 60.5; 60/479

(56) References Cited

U.S. PATENT DOCUMENTS

| | | | | |
|---|---|---|---|---|
| 4,787,295 A | * | 11/1988 | Obermeier-Wagner et al. | 92/158 |
| 4,841,927 A | * | 6/1989 | Slee | 123/193 C |
| 4,957,416 A | * | 9/1990 | Miller et al. | 417/273 |
| 5,002,165 A | * | 3/1991 | Organ | 188/282 |
| 5,004,404 A | * | 4/1991 | Pierrat | 917/53 |
| 5,030,065 A | * | 7/1991 | Baumann | 417/273 |
| 5,033,940 A | * | 7/1991 | Baumann | 417/273 |
| 5,839,342 A | * | 11/1998 | Cope et al. | 83/583 |
| 5,849,059 A | * | 12/1998 | Mizuno et al. | 417/273 |
| 5,870,980 A | * | 2/1999 | Hooper et al. | 123/58.6 |
| 5,957,220 A | * | 9/1999 | Coffman et al. | 173/91 |
| 6,039,535 A | * | 3/2000 | Kobayashi et al. | 415/172.1 |
| 6,164,422 A | * | 12/2000 | Sanitate et al. | 188/27.4 |
| 6,283,723 B1 | * | 9/2001 | Milburn et al. | 417/273 |
| 6,293,764 B1 | * | 9/2001 | Baumann | 417/273 |
| 6,324,959 B1 | * | 12/2001 | Akasaka et al. | 92/57 |

FOREIGN PATENT DOCUMENTS

| | | | |
|---|---|---|---|
| DE | 41 39 907 A1 | * | 6/1993 |
| JP | 10 221192 A | * | 8/1998 |
| JP | 11 280649 A | * | 10/1999 |
| JP | 2001 82332 A | * | 3/2001 |

OTHER PUBLICATIONS

Karassik, et al., "Pump Handbook", McGraw Hill, 2nd Ed., 1986, pp. 3.40.*

* cited by examiner

*Primary Examiner*—Charles G. Freay
*Assistant Examiner*—Han L. Liu
(74) *Attorney, Agent, or Firm*—Darby & Darby

(57) ABSTRACT

There is disclosed a high-pressure compressor comprising a compression mechanism for reciprocating/driving a piston with respect to a conventional cylinder by rotation of a motor and compressing an operating fluid sucked by this driving to generate the high-pressure operating fluid according to improvements in a piston shape, positions of a cylinder operation surface and the piston, specifics shapes of the cylinder and piston, and connecting constitution of the piston to a connecting rod, which solves problems such as occurrence of wear on a cylinder inner surface by displacement of the piston, size enlargement by an increase of a removal capacity, difficulty in processing the piston and connecting rod, and a large top clearance.

41 Claims, 35 Drawing Sheets

COMPRESSION APPARATUS

BACKGROUND OF THE INVENTION

The present invention relates to a high-pressure compressor of a compression type provided with a compression mechanism for compressing a sucked operating fluid to generate a high-pressure operating fluid, particularly to an improvement of a compression mechanism for reciprocating/driving a piston with respect to a cylinder by rotation of a motor.

For a high-pressure compressor of a compression type provided with a compression mechanism for reciprocating/driving a piston with respect to a cylinder by rotation of a motor and compressing an operating fluid sucked by the driving to generate a high-pressure operating fluid, as the invention by the present applicant, a multistage compression apparatus (hereinafter referred to the prior art) is disposed as one high-pressure gas compressor invented before the application date of the present application, for example, in Japanese Patent Application Laid-Open No. 81780/1999.

The prior art will be described hereinafter based on FIGS. 1 to 4. A multistage compression apparatus 100 constitutes a four-stage compressor provided with four compression sections (compression stages) 101, 102, 103, 104. The compression sections 101 and 103 are arranged on a horizontal axis 106, the compression sections 102 and 104 are arranged on a horizontal axis 105, and a reciprocating compression mechanism is constituted in which a piston as a movable member reciprocates/operates on these axes 106, 105 in a cylinder as a fixed member. Thereby, the operating fluid sucked via a suction pipe 118 is compressed in the first compression section 101, subsequently the operating fluid compressed in the first compression section 101 is passed via a pipeline 5 into the second compression section 102 and compressed, the operating fluid compressed in the second compression section 102 is passed via a pipeline 6 into the third compression section 103 and compressed, the operating fluid compressed in the third compression section 103 is passed via a pipeline 7 into the fourth compression section 104 and compressed, and the high-pressure operating fluid provided with a predetermined pressure and flow rate in this manner is discharged via a discharge pipe 8.

Examples of the operating fluid in the multistage compression apparatus 100 include nitrogen, natural gas, sulfur hexafluoride (SF6), air, and other so-called gases, and the multistage compression apparatus 100 is applied to a natural gas charging machine to a car bomb using a natural gas, high-pressure nitrogen gas supply to a gas injection molding machine using a high-pressure nitrogen gas during injection molding of synthetic resin, a charging machine of high-pressure air to an air bomb, and the like.

In the multistage compression apparatus 100, a piston 51 in the first compression section 101 and a piston 53 of the third compression section 103 are connected to a yoke 1A on the axis 106, and a cross slider 2A movably disposed to cross the axis 106 in the yoke 1A is connected to a crank shaft 4 via a crank pin 3. The axis 105 forms an angle of 90 degrees with the axis 106 in a vertical view. Moreover, a piston 52 of the second compression section 102 and a piston 54 of the fourth compression section 104 are connected to a yoke 1B on the axis 105, and a cross slider 2B movably disposed to cross the axis 105 in the yoke 1B is connected to the crank shaft 4 via the crank pin 3.

The crank shaft 4 is rotated by an electric motor (not shown) disposed below the compression sections 101 to 104, the crank pin 3 disposed on the crank shaft 4 in an eccentric manner is rotated around the crank shaft 4, with respect to the yoke 1A the cross slider 2A moves to handle displacement of the crank pin 3 in a direction of axis 105, the yoke 1A moves to handle the displacement of a direction of axis 106, and the pistons 51, 53 reciprocate only in the direction of the axis 106.

On the other hand, with respect to the yoke 1B, the cross slider 2B moves to handle the displacement of the crank pin 3 in the direction of axis 106, the yoke 1B moves to handle the displacement of the direction of axis 105, and the pistons 52, 54 then reciprocate only in the direction of the axis 105.

FIG. 4 is a sectional view showing a structure of the first compression section 101 of the multistage compression apparatus 100. The first compression section 101 is provided with a first compression chamber 58 and a second compression chamber 59 before and after the piston 51. When the piston 51 advances and valves a, b are closed, the operating fluid is sucked into the first compression chamber 58 via opened valves e, f from directions shown by arrows. Additionally, when the operating fluid of the second compression chamber 59 is compressed to reach a predetermined pressure, the fluid is discharged to the outside via opened valves c, d, and fed to the next second compression section 102 via the pipeline 5 as shown by an arrow.

Subsequently, when the piston 51 moves backward, the valves e, f are closed, the operating fluid in the first compression chamber 58 is compressed to reach the predetermined pressure and open the valves a, b, and the operating fluid is discharged to the second compression chamber 59. Numeral 60 denotes a rod guide for smoothly guiding a connecting rod 57 to a predetermined position so that no vibration occurs.

As described above, the first compression section 101 of the multistage compression apparatus 100 is a double compression mechanism (double action mechanism) structured to suck, compress and discharge the operating fluid in two stages in one cylinder 55. The second, third and fourth compression sections 102, 103, 104 do not comprise the double compression mechanism like the first compression section 101, and comprise a so-called single action mechanism constituted to perform a usual operation of compressing the gas sucked into the cylinder in one stage in the reciprocating motion of the piston with respect to the cylinder.

In the aforementioned constitution, a nitrogen gas as the operating fluid sucked via the suction pipe 118 indicates a pressure of about 0.05 MPa (G), and is compressed by the first compression section 101 until the pressure indicates about 0.5 MPa (G), and the compressed nitrogen gas is supplied to the second compression section 102 via the pipeline 5. The nitrogen gas is compressed to indicate about 2 MPa (G) in the second compression section 102, and the compressed nitrogen gas is supplied to the third compression section 103 via the pipeline 6. The nitrogen gas is compressed to indicate about 7 to 10 MPa (G) in the third compression section 103, and the compressed nitrogen gas is supplied to the fourth compression section 104 through the pipeline 7. In the fourth compression section 104, the high-pressure gas (high-pressure operating fluid) compressed to indicate about 20 to 30 MPa (G) is supplied to an accumulator via the discharge pipe 8, and the high-pressure nitrogen gas is supplied to a gas injection molding machine from the accumulator.

In the aforementioned prior art, as a first constitution, for the pistons 53, 54 of the third and fourth compression sections 103 and 104, as shown in FIG. 5 and FIG. 6 as an enlarged view of a circle P of FIG. 5, a plurality of labyrinth grooves 70 are formed in the peripheral surfaces of the pistons 53, 54, in the compression mechanism, a gap of 2 to 6 $\mu$m (micrometers) is formed between the piston 53, 54 and a liner cylinder 73A, 74A disposed on the inner surface of the cylinder 73, 74, and the gas flowing through the gap flows into the labyrinth groove 70 and generates a turbulence for a gas sealing system to form a so-called non-lubricating labyrinth seal structure. Moreover, a tip end peripheral edge 75 of the piston 53, 54 is obliquely and linearly chamfered, so-called C-chamfered, and an open edge 76 of the labyrinth groove 70 is formed as a sharp edge.

Moreover, as a second constitution, as shown in FIG. 7, in the third and fourth compression sections 103, 104, in a top dead point in reciprocating/driving of the piston 53, 54, a rear end 78 of the piston 53, 54 is positioned inside the liner cylinder 73A, 74A by a length L1. Moreover, as shown in FIG. 8, in a lower dead point, a tip end 77 of the piston 53, 54 is positioned inside the liner cylinder 73A, 74A by a length L2. Specifically, the length L1, L2 indicates a friction distance when the piston 53, 54 is displaced with respect to the liner cylinder 73A, 74A.

Furthermore, as a third constitution, as shown in FIG. 9, in the second compression section 102, an aluminum cylinder 72 forms a uniform cylindrical inner surface 81 with the same inner diameter (diameter of 75 mm) toward a discharge plate 80, and the piston 52 reciprocates along the cylindrical inner surface 81. The piston 52 is provided with a plurality of PTFE piston rings 83 at intervals to seal with the cylinder 72. As shown in FIG. 10, a piston plate 84 is fixed to the tip end of the piston 52 to support the piston ring 83 on the tip end.

Additionally, as a fourth constitution, as shown in FIG. 11, in the third and fourth compression sections 103 and 104, the pistons 53, 54 are connected to the yokes 1A, 1B via connecting rods 85, 86, respectively, and reciprocate in the cylinders 73, 74 by rotation of the electric motor. In the connection of the piston 53 to the connecting rod 85, and the connection of the piston 54 to the connecting rod 86, male connectors 87, 88 extended from the pistons 53, 54 engage with female connectors 89, 90 formed in the connecting rods 85, 86 so that mutual rotation is possible. Numerals 91, 92 denote guide rings disposed on the connecting rods 85, 86, respectively. Numerals 79, 79A denote reinforcing materials embedded in the connecting rods 85, 86 in positions where the male connectors 87, 88 contact.

Moreover, as a fifth constitution, in the third and fourth compression sections 103 and 104, the pistons 53, 54 shown in FIG. 12 have flat surfaces on tip ends as shown in FIGS. 5 and 6. Furthermore, the respective tip end peripheral portions 75 are obliquely and linearly chamfered, so-called C-chamfered.

In the aforementioned prior art, in the first constitution shown in FIGS. 5 and 6, there is a problem that the inner surfaces of the cylinders 73, 74 are worn by the pistons 63, 54. Specifically, the piston 53, 54 is disposed in the horizontal direction, and is displaced downward by its weight by the gap between the piston 53, 54 and the liner cylinder 73A, 74A to contact the inner surface of the liner cylinder 73A, 74A before the compressor starts. When the compressor starts in this state, a phenomenon disadvantageously occurs in which the inner surface of the liner cylinder 73A, 74A is scraped by the tip end of the piston 53, 54 and the edge of the opening end of the labyrinth groove 70.

Moreover, in the aforementioned prior art, in the second constitution shown in FIGS. 7 and 8, there is a problem that the inner surfaces of the liner cylinders 73A, 74A are worn by the pistons 53, 54. Specifically, in the top and lower dead points of the pistons 53, 54, the ends 77, 78 of the pistons 53, 54 are positioned in the liner cylinders 73A, 74A by the lengths L1, L2. Therefore, in the downward displacement of the pistons 53, 54, the phenomenon occurs in which the tip and rear ends of the pistons 53, 54 scrape the inner surfaces of the liner cylinders 73A, 74A.

Furthermore, in the prior art, in the third constitution shown in FIGS. 9 and 10, since the inner surface of the cylinder 72 is a uniform cylindrical inner surface with the same inner diameter, in order to enlarge a removal capacity in a compression process, a cylinder inner diameter and a piston outer diameter have to be enlarged, and there is a problem that size enlargement necessarily results.

Additionally, in the prior art, in the fourth constitution shown in FIG. 11, the piston is connected to the connecting rod by the engaging connection of the male connector with the female connector, and there is a problem that a processing for accurately keeping a processing precision of the engaging connection portion is considerably laborious. Moreover, the reinforcing material is necessary for maintaining performance.

Moreover, in the fifth constitution in the prior art, there is a problem that the inner surfaces of the liner cylinders 73A, 74A are worn by the pistons 53, 54. Specifically, since the piston 53 (54) in FIG. 12 has the flat surface as the tip end surface, and the tip end peripheral edge 75 is C-chamfered, in the downward displacement of the pistons 53, 54 the phenomenon of scraping the inner surfaces of the liner cylinders 73A, 74A occurs, and there is also a problem that a top clearance increases.

SUMMARY OF THE INVENTION

In consideration of the aforementioned problems, an object of the present invention is to provide a compression apparatus of a compression system high-pressure compressor in which wear of a cylinder inner surface as in the prior art is prevented, removal capacity is increased, processing is facilitated, and top clearance is reduced so that properties can be enhanced. For this purpose, as one concrete means for solving the problem, there is provided a high-pressure compressor comprising a compression mechanism for reciprocating/driving a piston with respect to a cylinder by rotation of a motor and compressing an operating fluid sucked by the driving to generate a high-pressure operating fluid. In the high-pressure compressor, the compression mechanism comprises a labyrinth seal structure in which a plurality of labyrinth grooves are formed in a peripheral surface of the piston and no lubrication is performed between the peripheral surface of the piston and an operation inner surface of the cylinder, and a tip end peripheral edge of the piston and an opening end of the labyrinth groove are R-chamfered.

Moreover, according to the present invention, as one concrete means for solving the problem, there is provided a high-pressure compressor comprising a compression mechanism for reciprocating/driving a piston with respect to a cylinder by rotation of a motor and compressing an operating fluid sucked by the driving to generate a high-pressure operating fluid. In the high-pressure compressor, the compression mechanism comprises a labyrinth seal structure in which a plurality of labyrinth grooves are formed in a peripheral surface of the piston and no lubrication is performed between the peripheral surface of the piston and an operation inner surface of the cylinder, and for a relation between the piston and the cylinder, in a top dead point and a lower dead point in the reciprocating/driving of the piston, a tip end peripheral edge and a rear end peripheral edge of the piston are substantially positioned not to enter the operation inner surface of the cylinder.

Furthermore, according to the present invention, as one concrete means for solving the problem, there is provided a high-pressure compressor comprising a compression mechanism for reciprocating/driving a piston with respect to a cylinder by rotation of a motor and compressing an operating fluid sucked by the driving to generate a high-pressure operating fluid. In the high-pressure compressor, the compression mechanism comprises a non-lubricating seal structure between an operation inner surface of the cylinder and the piston, a tip end small diameter portion is formed on the piston, and a small diameter compression section into which the tip end small diameter portion of the piston is inserted when the piston is in a top dead point, and a large diameter portion for forming a compression space in the periphery of the tip end small diameter portion of the piston when the piston is in a lower dead point are continuously formed on the cylinder.

Additionally, according to the present invention, as one concrete means for solving the problem, there is provided a high-pressure compressor comprising a compression mechanism for reciprocating/driving a piston with respect to a cylinder by rotation of a motor and compressing an operating fluid sucked by the driving to generate a high-pressure operating fluid. In the high-pressure compressor, the compression mechanism comprises a non-lubricating seal structure between an operation inner surface of the cylinder and the piston, and the piston is connected to a connecting rod by pressing a connecting flange portion extended to a rear end of the piston in a connection space formed in the connecting rod by a spring so that the piston can oscillate with respect to the connecting rod.

Moreover, according to the present invention, as one concrete means for solving the problem, there is provided a high-pressure compressor comprising a compression mechanism for reciprocating/driving a piston with respect to a cylinder by rotation of a motor and compressing an operating fluid sucked by the driving to generate a high-pressure operating fluid. In the high-pressure compressor, the compression mechanism comprises a non-lubricating seal structure between an operation inner surface of the cylinder and the piston, and a shape of a tip end of the piston and a shape of an inner surface of a cylinder head opposite to the tip end are formed in substantially the same R shape.

Furthermore, according to the present invention, there is provided a compression apparatus, provided with a plurality of stages of compression sections each comprising a cylinder and a piston, for successively passing a gas through the respective compression sections to compress and supply the gas, in which the compression section of the final stage and the compression section of the stage before the final stage are provided with plunger pistons.

Additionally, in the aforementioned invention, a gap in a diametric direction between the cylinder of the compression section of the final stage and the piston reciprocating/operating inside the cylinder is smaller than a gap between the cylinder of the stage before the final stage and the piston reciprocating/operating in the cylinder.

Moreover, in the aforementioned invention, the gap of the diametric direction between the cylinder of the compression section of the stage before the final stage and the piston reciprocating/operating in the cylinder is in a range of 3 to 10 $\mu$m.

Furthermore, in the aforementioned invention, the gap of the diametric direction between the cylinder of the compression section of the final stage and the piston reciprocating/operating in the cylinder is in a range of 2 to 8 $\mu$m.

Additionally, in the aforementioned invention, the piston reciprocating/operating in the cylinder of the compression section of the stage before the final stage is provided with a plurality of grooves on a surface, and a ratio (B/A) of a groove depth B to a groove width A is in a range of 0.2 to 0.5.

Moreover, in the aforementioned invention, the compression section is constituted of four stages.

Furthermore, according to the present invention, there is provided a compression apparatus comprising a plurality of compression sections. At least one of the compression sections comprises a plunger piston type compressor, the plurality of compression sections are connected in series by a connection pipe, and a compression process of feeding an operating fluid compressed by the compression section of a previous stage to the compression section of a subsequent stage, and compressing the operating fluid in the compression section of the subsequent stage is successively performed to generate the high-pressure operating fluid. In the compression apparatus, a plunger piston in the plunger piston type compressor is sealed by a labyrinth seal constituted by a plurality of labyrinth grooves, the labyrinth grooves are formed so that a forming density decreases to the side of a back pressure chamber from the side of a compression chamber, and a seal property is improved.

Additionally, there is provided a compression apparatus comprising: compression means provided with a plurality of compression sections; driving means for driving the compression means; and a sealed case in which the driving means is disposed and whose top portion closely abuts on the compression means. In the compression apparatus, a relief valve, opened when a pressure in the sealed case is equal to or more than a predetermined pressure, is disposed on a bottom of the sealed case, and worn powder of a movable portion, and the like can be discharged to the outside of the apparatus via the relief valve without disassembling/cleaning the apparatus.

Moreover, according to the present invention, there is provided a compression apparatus in which at least one reciprocating compression section of a plurality of reciprocating compression sections is constituted by a plunger pump, and the plurality of reciprocating compression sections are connected to compress a required gas in multiple stages. In the compression apparatus, the plunger pump comprises a piston inserted into a ceramic cylinder liner, and a connecting rod connected to the piston, a sleeve is interposed as a pressure resistant structure member between the cylinder liner and a plunger pump main body, and the cylinder liner and sleeve are fixed to the plunger pump main body via a fixing bolt.

Furthermore, in the aforementioned invention, elastic cushion members such as a leaf spring are interposed and attached between a connecting rod sleeve into which the connecting rod is inserted and the fixing bolt.

Additionally, in the aforementioned invention, one or two or more pressure release grooves are disposed through a thickness direction in a surface by which the sleeve as the pressure resistant structure member contacts the fixing bolt.

Moreover, in the aforementioned invention, one or two or more pressure release holes are disposed through the connecting rod sleeve.

Furthermore, in the aforementioned invention, a width of either one or both of a piston ring groove and a guide ring groove, disposed in the piston, for attaching a piston ring and a guide ring, is larger than the width of the ring itself.

Additionally, according to the present invention, there is provided a compression apparatus, provided with at least one pair of opposite pistons, a yoke to which the pistons are fixed, and a cross slider for sliding and moving in the yoke, for obtaining a reciprocating motion of the piston from a rotation motion of a crank shaft through conversion by a scotch yoke mechanism, in which a cover provided with an opening in a middle portion not to inhibit a crank pin motion is fixed and disposed to sandwich the yoke.

Moreover, in the aforementioned invention, the cover is shrink-fitted and fixed to the yoke.

Furthermore, according to the present invention, in the aforementioned compression apparatus, a position of at least one pair of opposite positions is provided with no piston, and the position is provided with a connecting rod fixed to the yoke, and a cylinder for guiding the connecting rod so that the connecting rod can reciprocate.

Additionally, according to the present invention, there is provided a compression apparatus, provided with a plurality of reciprocating compression sections, for compressing a gas in multiple stages, in which at least the reciprocating compression section of the first stage is provided with a first compression chamber and a second compression chamber, and a double compression structure of discharging a gas sucked and compressed in the first compression chamber to the second compression chamber and again compressing the gas and subsequently discharging and feeding the gas to the reciprocating compression section of the next stage is disposed.

DETAILED DESCRIPTION OF THE PREFERRED EMBODIMENT

Figure 1:
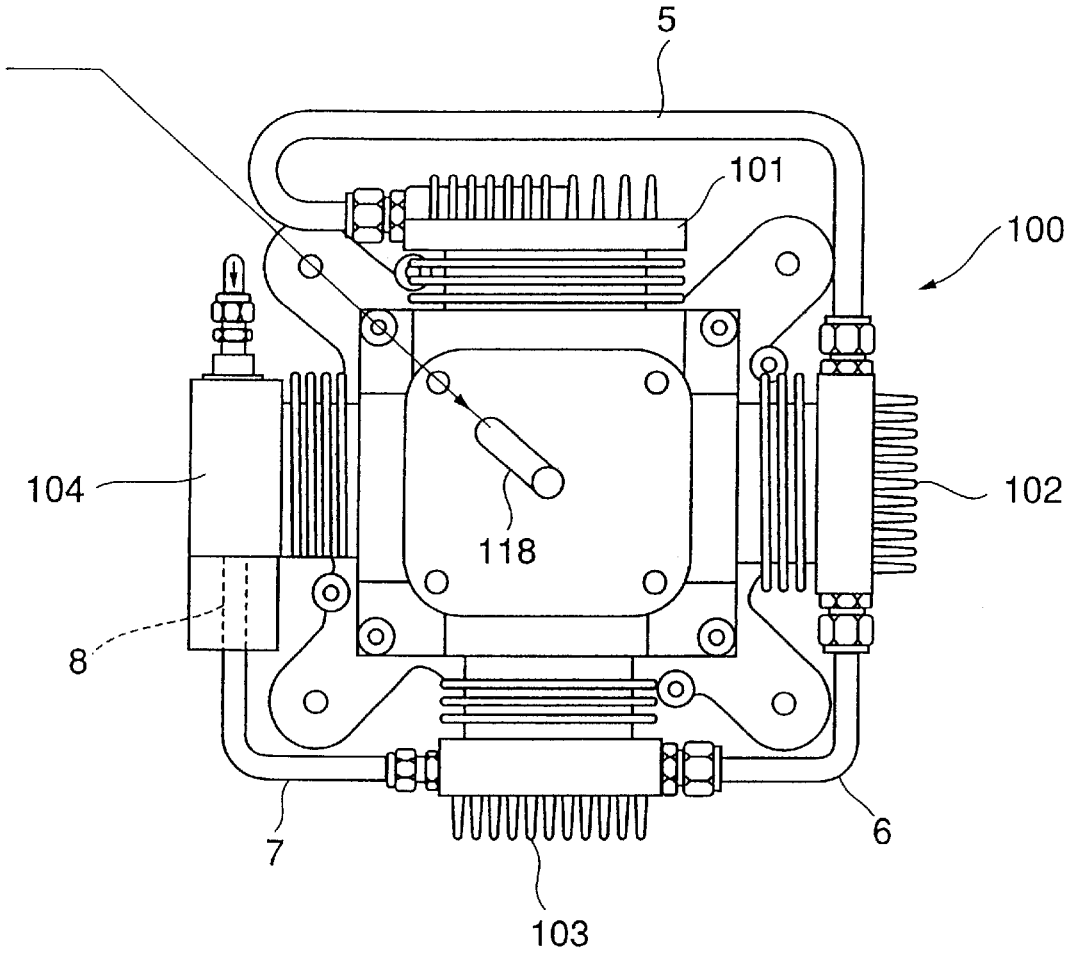
FIG.1 PRIOR ART
FIG. 1 is a plan view of a multistage compression apparatus of one embodiment as an object of the present invention.
Figure 2:
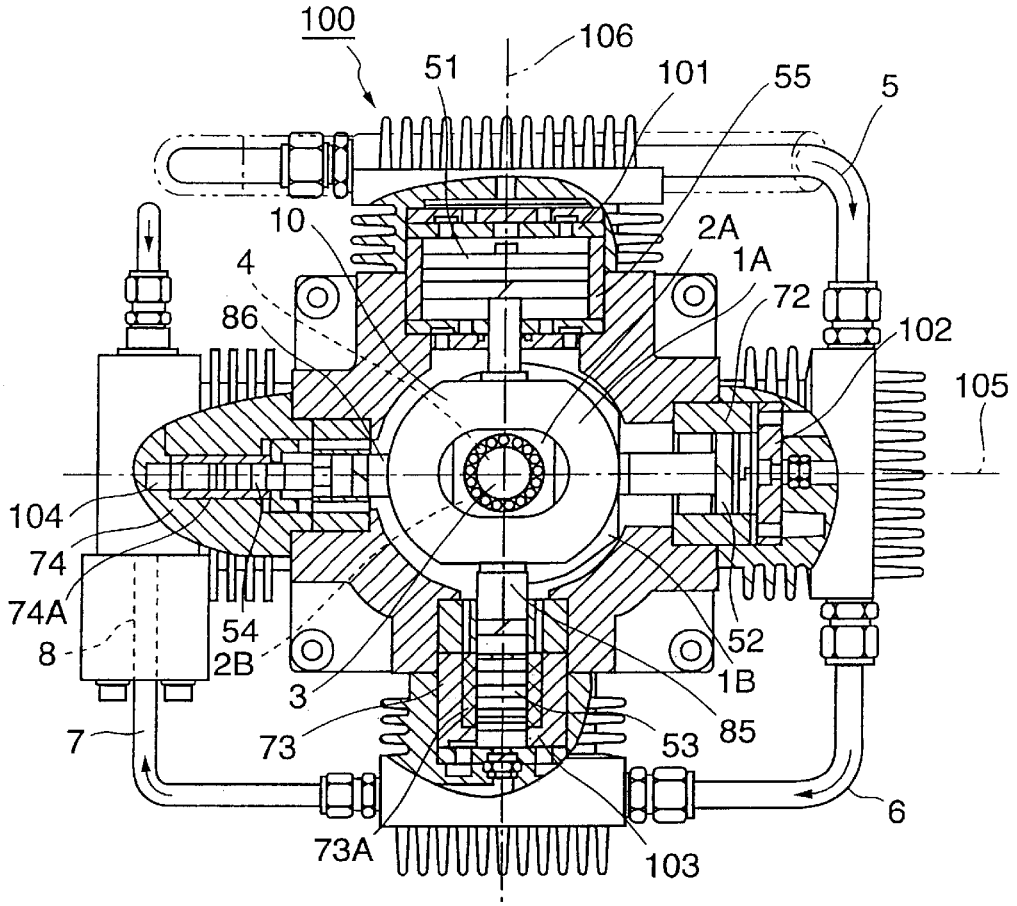
FIG.2 PRIOR ART
FIG. 2 is a plan view showing a section of each compression mechanism of the multistage compression apparatus of one embodiment as the object of the present invention.
Figure 3:
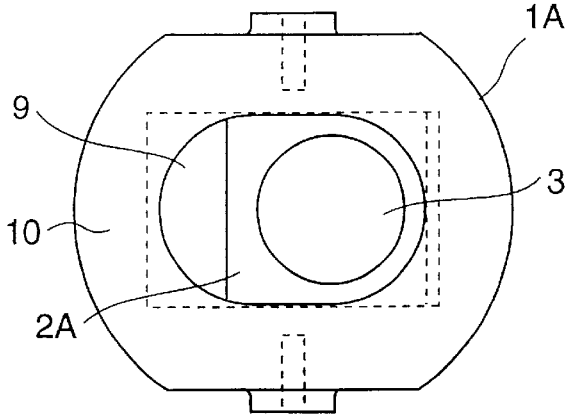
FIG.3 PRIOR ART
FIG. 3 is a plan view of a yoke and cross slider of the multistage compression apparatus according to one embodiment as the object of the present invention.
Figure 4:
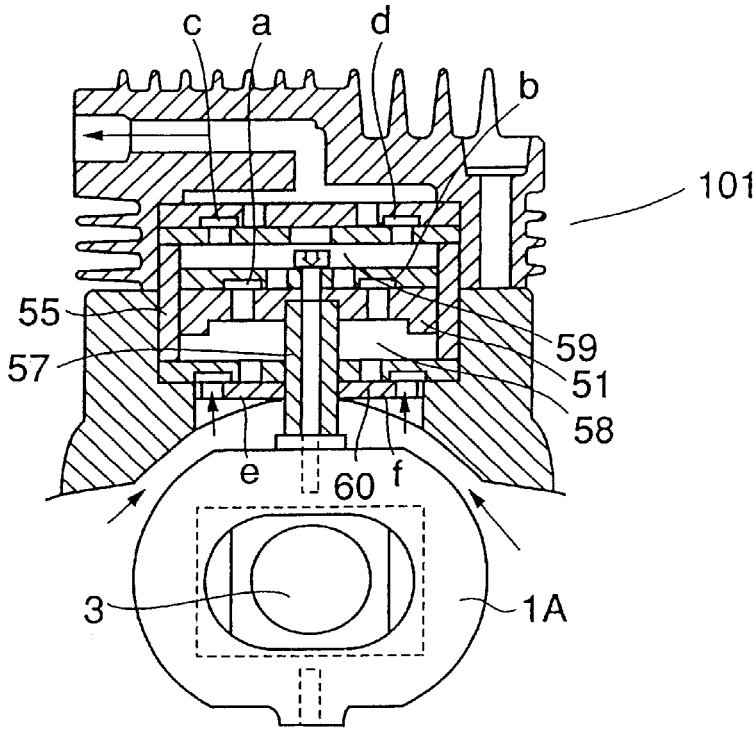
FIG.4 PRIOR ART
FIG. 4 is a sectional view of the compression mechanism of a first stage of the multistage compression apparatus according to one embodiment as the object of the present invention.
Figure 5:
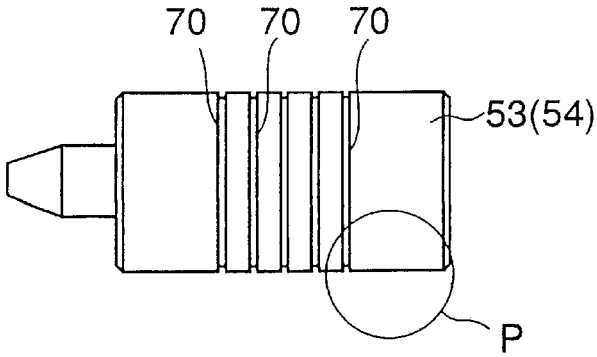
FIG. 5 is a side view of a piston according to a prior-art first constitution.
Figure 6:
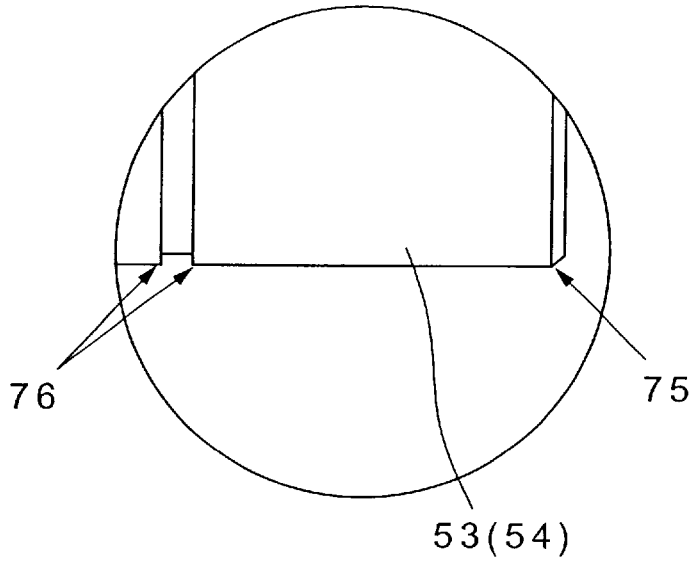
FIG. 6 is an enlarged view of a circle P of FIG. 5.
Figure 7:
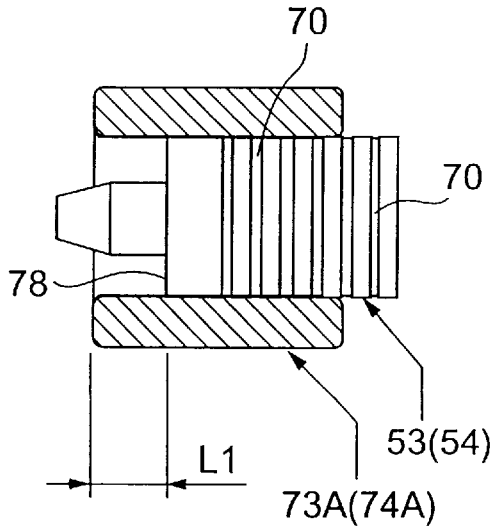
FIG. 7 is a diagram showing a relation between a piston top dead point and a liner cylinder according to a prior-art second constitution.
Figure 8:
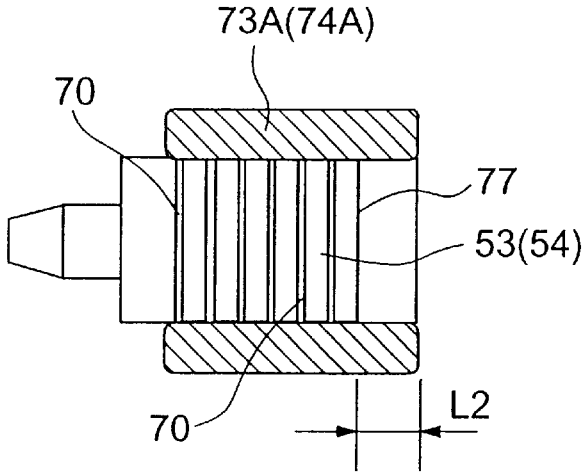
FIG. 8 is a diagram showing a relation between a piston lower dead point and the liner cylinder according to the prior-art second constitution.

Embodiments of the present invention will next be described. In the present invention, since a specific part of the compression type high-pressure compressor 100 described in the aforementioned prior art is developed as the invention, components equivalent to those of the high-pressure compressor 100 described in the aforementioned prior art are denoted by the reference numerals of the high-pressure compressor 100 described in the aforementioned prior art.

Figure 13:
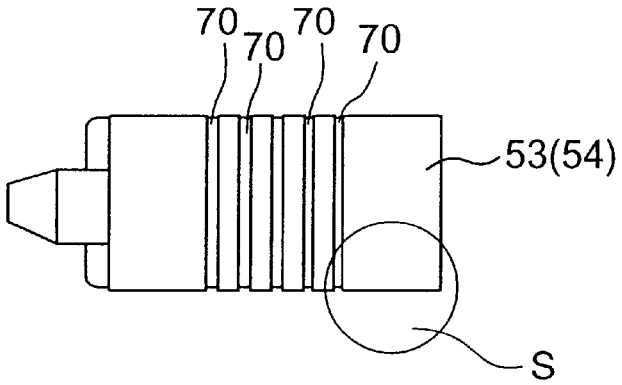
FIG. 13 is a side view of the piston of the present invention with respect to the prior-art first constitution.
Figure 14:
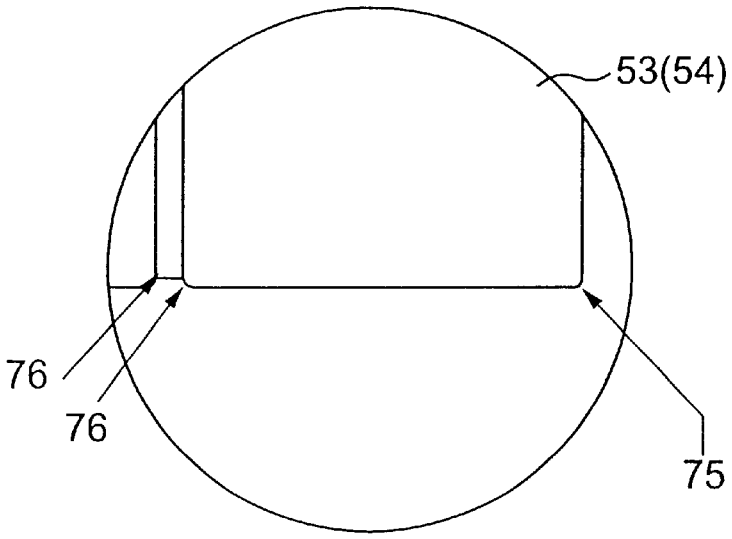
FIG. 14 is an enlarged view of a circle S of FIG. 13.

The present invention with respect to the first constitution in the aforementioned prior art is shown in FIG. 13 and FIG. 14 as an enlarged view of a circle S of FIG. 13. Specifically, in the high-pressure compressor 100 provided with a compression mechanism for reciprocating/driving a piston 53 (54) with respect to a cylinder 73 (74) by rotation of a motor and compressing an operating fluid sucked by the driving to generate a high-pressure operating fluid, the compression mechanism is provided with a labyrinth seal structure in which a plurality of labyrinth grooves 70 are formed in a peripheral surface of the piston 53 (54), and no lubrication is performed between the piston and an operation inner surface of the cylinder 73 (74), that is, a liner cylinder 73A, 74A, and a tip end peripheral edge 75 of the piston 53 (54) and an opening end 76 of the labyrinth groove 70 are R-chamfered. The multistage compression apparatus of the high-pressure compressor 100 is shown. As an appropriate embodiment of the R chamfer, the tip end peripheral edge 75 indicates 1R, the opening end 76 indicates 0.3R, and the labyrinth groove 70 has a semicircular section with a width of 1 mm and a depth of 0.5 mm.

Therefore, even when the piston 53, 54 is displaced downward by its weight by a gap between the piston 53, 54 and the liner cylinder 73A, 74A to contact the inner surface of the liner cylinder 73A, 74A, different from the prior art, the inner surface of the liner cylinder 73A, 74A can be prevented from being worn by the tip end peripheral edge 75 of the piston 53 (54) and the opening end 76 of the labyrinth groove 70.

For the present invention with respect to the first constitution in the prior art, a third compression section 103 and fourth compression section 104 are shown, but this is not limited within a technical scope of the present invention.

Figure 15:
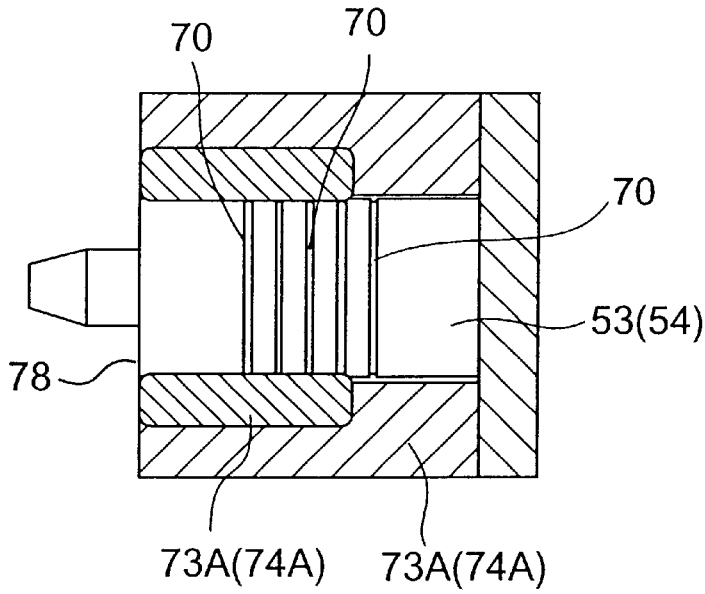
FIG. 15 is a diagram showing the relation between the piston top dead point and the liner cylinder of the present invention with respect to the prior-art second constitution.
Figure 16:
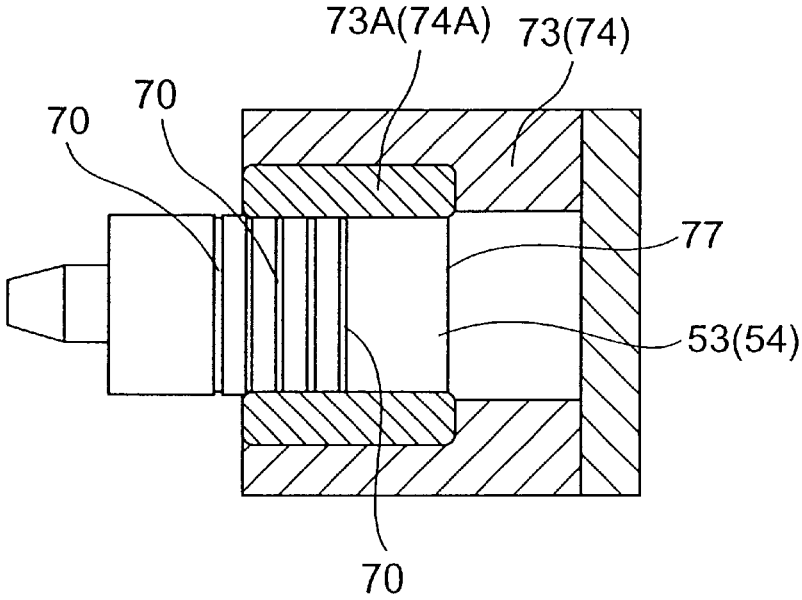
FIG. 16 is a diagram showing the relation between the piston lower dead point and the liner cylinder of the present invention with respect to the prior-art second constitution.

Next, the present invention with respect to the second constitution of the prior art is shown in FIGS. 15 and 16. Specifically, in the compression system high-pressure compressor 100 provided with the compression mechanism for reciprocating/driving the piston 53 (54) with respect to the cylinder 73 (74) by rotation of the motor and compressing the operating fluid sucked by the driving to generate the high-pressure operating fluid, the compression mechanism is provided with the labyrinth seal structure in which a plurality of labyrinth grooves 70 are formed in the peripheral surface of the piston 53 (54), and no lubrication is performed between the piston and the operation inner surface of the cylinder 73 (74), that is, the liner cylinder 73A, 74A. For a relation between the piston 53 (54) and the cylinder 73, 74, in a top dead point and a lower dead point in the reciprocating/driving of the piston 53 (54), a rear end peripheral edge 78 and a tip end peripheral edge 77 of the piston 53 (54) are substantially positioned not to enter the operation inner surface of the cylinder 73 (74). Such multistage compression apparatus of the high-pressure compressor is shown.

Therefore, even when the piston 53 (54) is displaced downward in top dead point and lower dead point positions, different from the prior art, the phenomenon that the tip and rear ends of the piston 53, 54 scrape the inner surface of the liner cylinder 73A, 74A can be prevented. When the piston 53, 54 is in the top dead point as shown in FIG. 15, the rear end peripheral edge of the piston 53 (54) substantially coincides with the rear end of the cylinder 73 (74). Moreover, when the piston 53, 54 is in the lower dead point as shown in FIG. 16, the tip end peripheral edge of the piston 53 (54) substantially coincides with the tip end of the liner cylinder 73A, 74A. Therefore, the length of the liner cylinder 73A, 74A can effectively be utilized in a compression stroke and labyrinth seal structure.

For the present invention with respect to the second constitution in the prior art, the third compression section 103 and fourth compression section 104 are shown, but this is not limited within the technical scope of the present invention.

Figure 9:
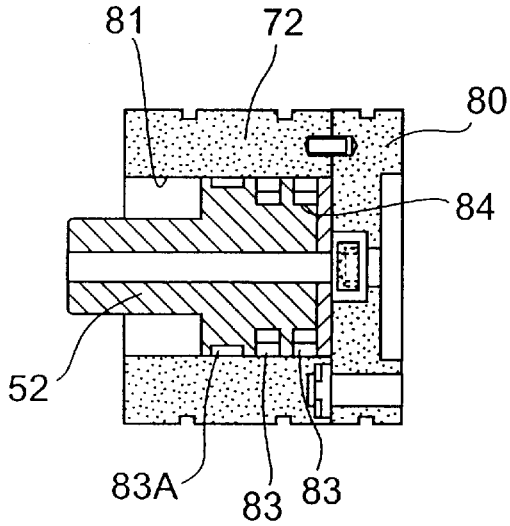
FIG. 9 is a diagram showing a relation between a piston and a cylinder according to a prior-art third constitution.
Figure 10:
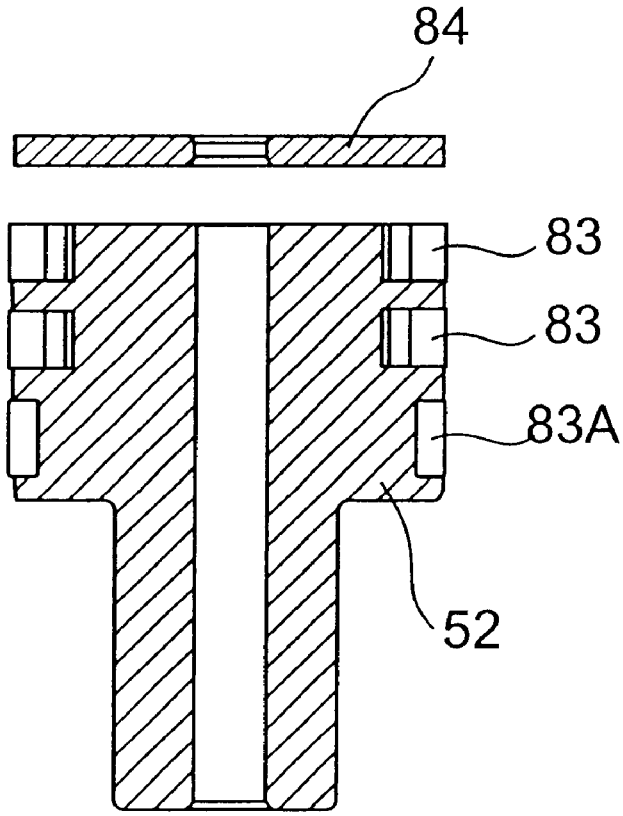
FIG. 10 is a schematic view of the piston according to the prior-art third constitution.
Figure 11:
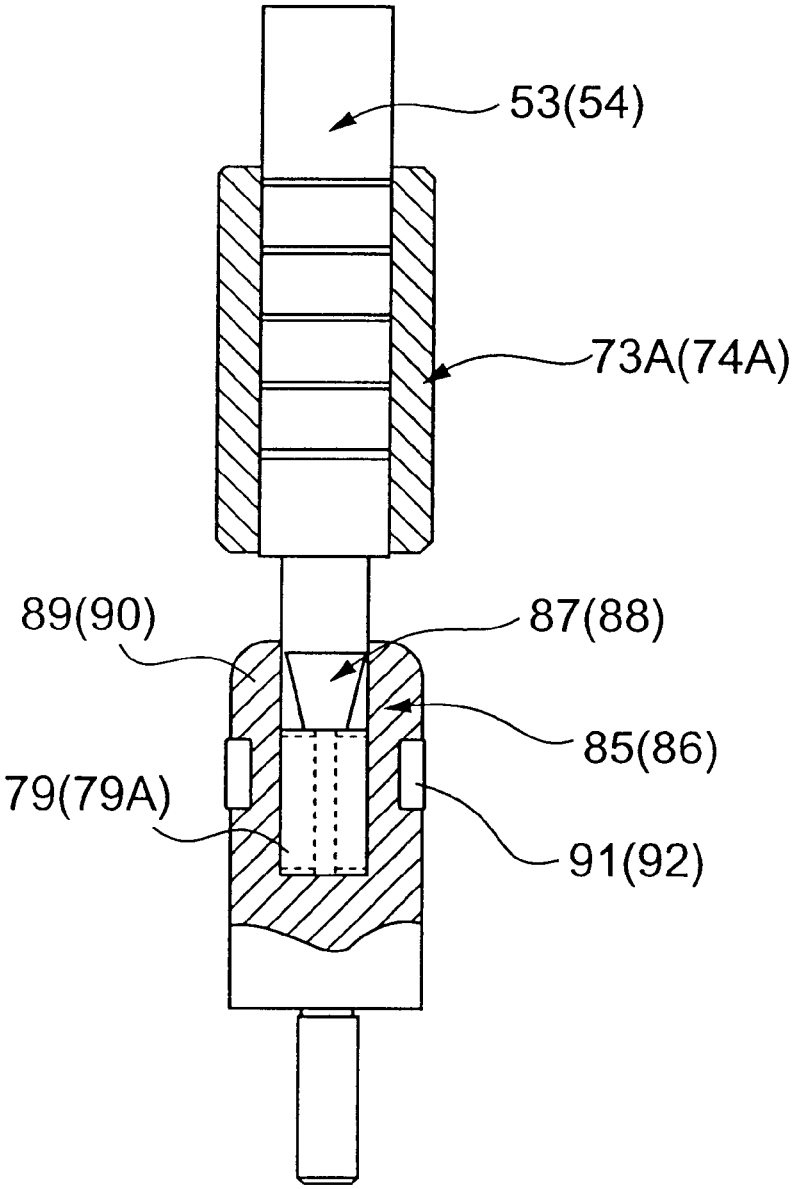
FIG. 11 is a schematic view of the piston of a connecting rod system according to a prior-art fourth constitution.
Figure 12:
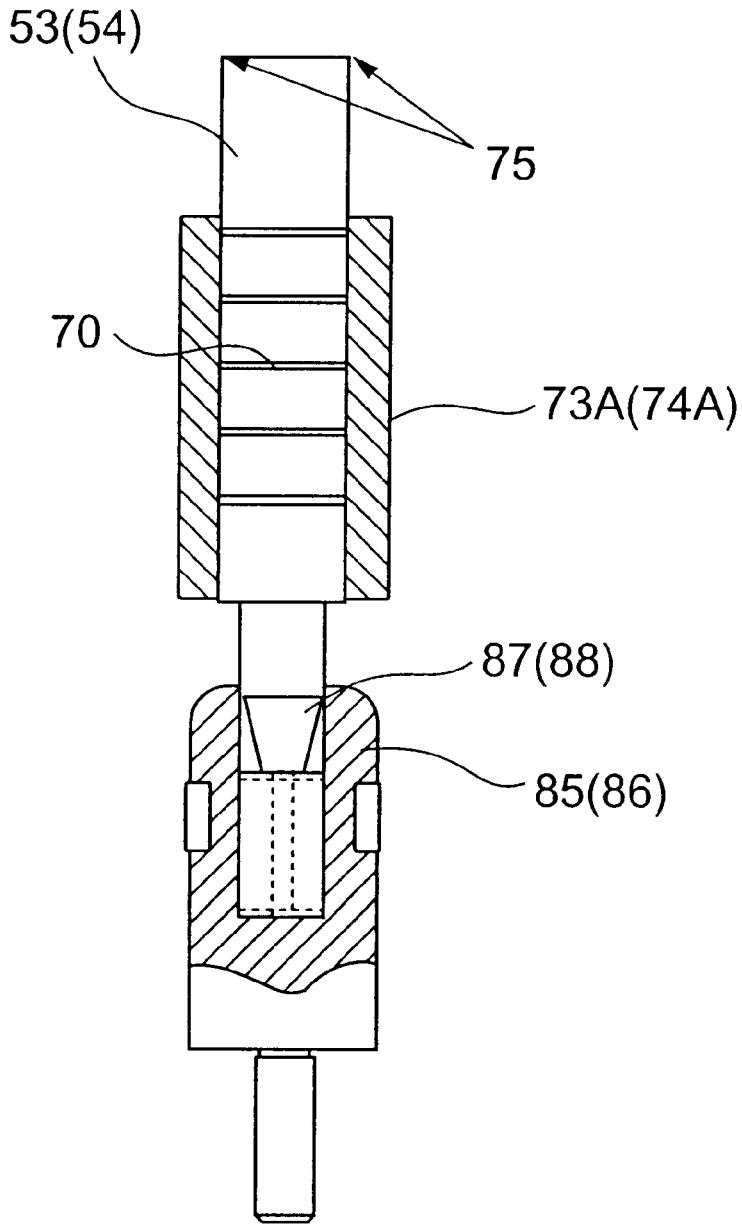
FIG. 12 is a schematic view of a compression section according to a prior-art fifth constitution.
Figure 17:
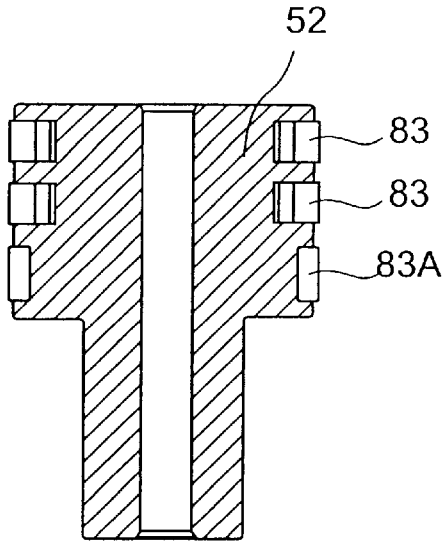
FIG. 17 is a schematic view of one embodiment of the piston of the present invention with respect to the prior-art third constitution.
Figure 18:
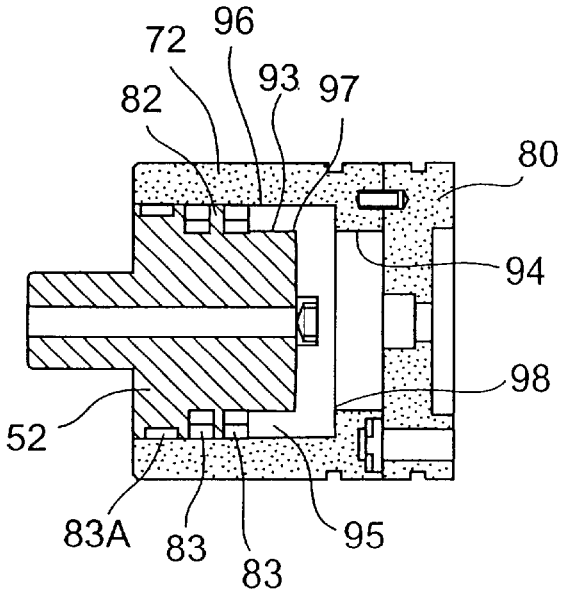
FIG. 18 is a diagram showing the relation between the piston lower dead point and the liner cylinder of the present invention with respect to the prior-art third constitution.
Figure 19:
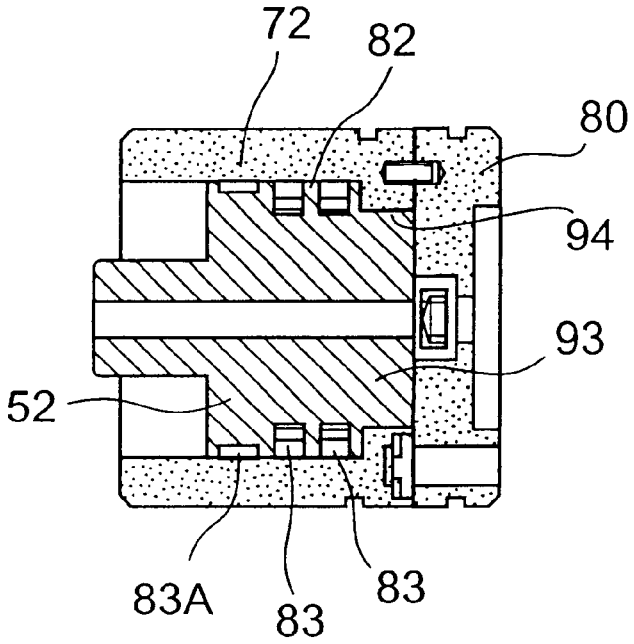
FIG. 19 is a diagram showing the relation between the piston top dead point and the liner cylinder of the present invention with respect to the prior-art third constitution.

Next, the present invention with respect to the third constitution of the prior art is shown in FIGS. 17 to 19. Specifically, in order to omit the piston plate 84 of the prior art, grooves for holding a piston ring 83 and a guide ring 83A are formed in the peripheral surface inside the peripheral surface of the tip end of a piston 52. Moreover, in the compression system high-pressure compressor 100 provided with the compression mechanism for reciprocating/driving the piston 52 with respect to a cylinder 72 by rotation of the motor and compressing the operating fluid sucked by the driving to generate the high-pressure operating fluid, the compression mechanism is provided with a non-lubricating seal structure between the operation inner surface of the cylinder 72 and the piston 52, and further for the piston 52 a tip-end small-diameter portion 93 is formed on a tip end of a large diameter portion 82. For the cylinder 72, a small diameter compression section 94 into which the tip end small diameter portion 93 of the piston is substantially tightly inserted when the piston 52 is in the top dead point, and a large diameter portion 96 for forming a compression space 95 in the periphery of the tip end small diameter portion 93 of the piston when the piston 52 is in the lower dead point are continuously formed. This multistage compression apparatus of the high-pressure compressor is shown. As an embodiment, the inner diameter of the small diameter compression section 94 is 75 mm, which is the same as the inner diameter of the prior-art cylinder 72 of FIG. 9. The inner diameter of the large diameter compression section 96 is 80 mm, which is larger than the inner diameter of the small diameter compression section 94 by about 10%.

Therefore, the large diameter compression section 96 serves as a first compression section, the small diameter compression section 94 serves as a second compression section and a two-stage compression constitution is formed. Moreover, the presence of the compression space 95 increases a compression capacity, that is, a removal capacity. For example, in a case in which a discharge gas flow rate in one day is increased to 200 $Nm^3$/day from 100 $Nm^3$/day or in another case, the constitution is effective as a measure for increasing a gas suction amount to increase a gas discharge amount from the compressor. Moreover, since the capacity can be increased without changing the outer diameter of the cylinder 72, the compressor is not enlarged in size. A tip end peripheral edge 97 of the piston 52 and an inlet peripheral edge 98 of the small diameter compression section 94 of the cylinder 72 are R-chamfered, and biting of the piston 52 and cylinder 72 is prevented.

For the present invention with respect to the third constitution in the prior art, the second compression section 102 is shown, but this is not limited within the technical scope of the present invention. When a first compression section 101 has a single action compression mechanism, the constitution of the present invention can be employed.

Figure 20:
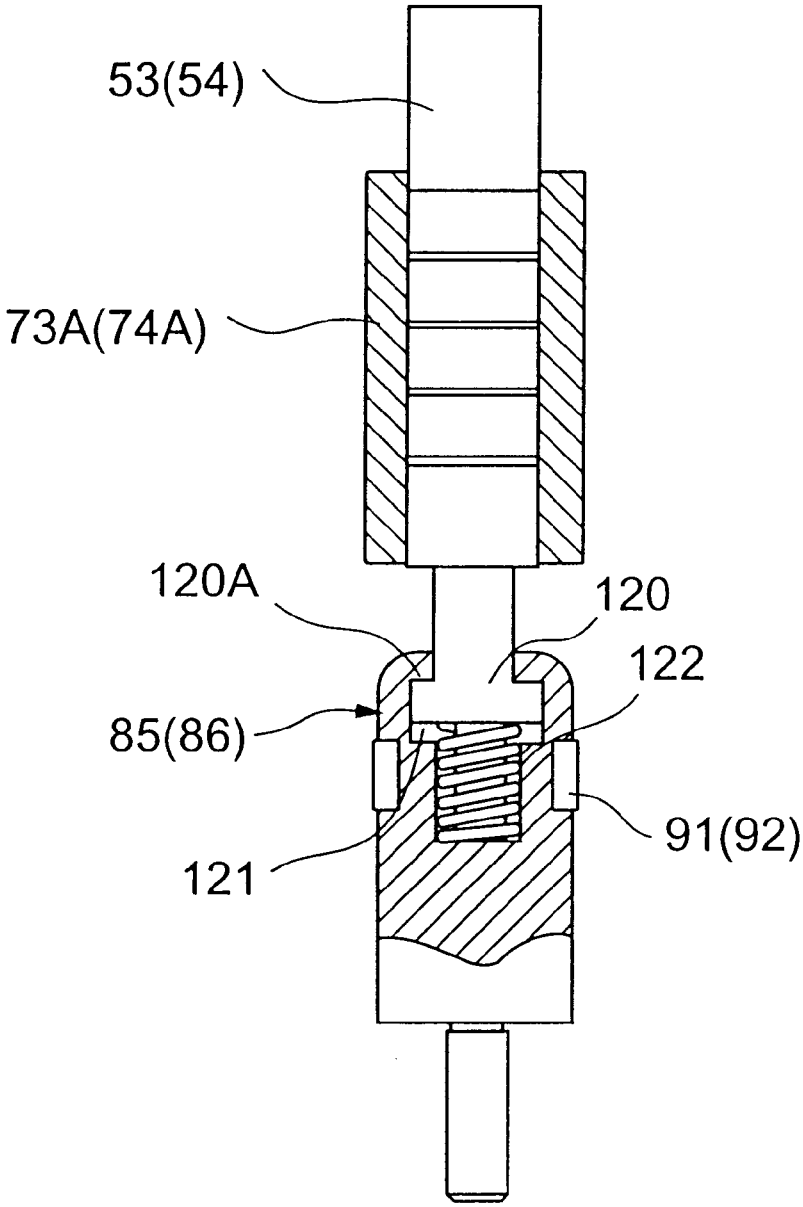
FIG. 20 is a schematic view of the piston of the connecting rod system of the present invention with respect to the prior-art fourth constitution.
Figure 21:
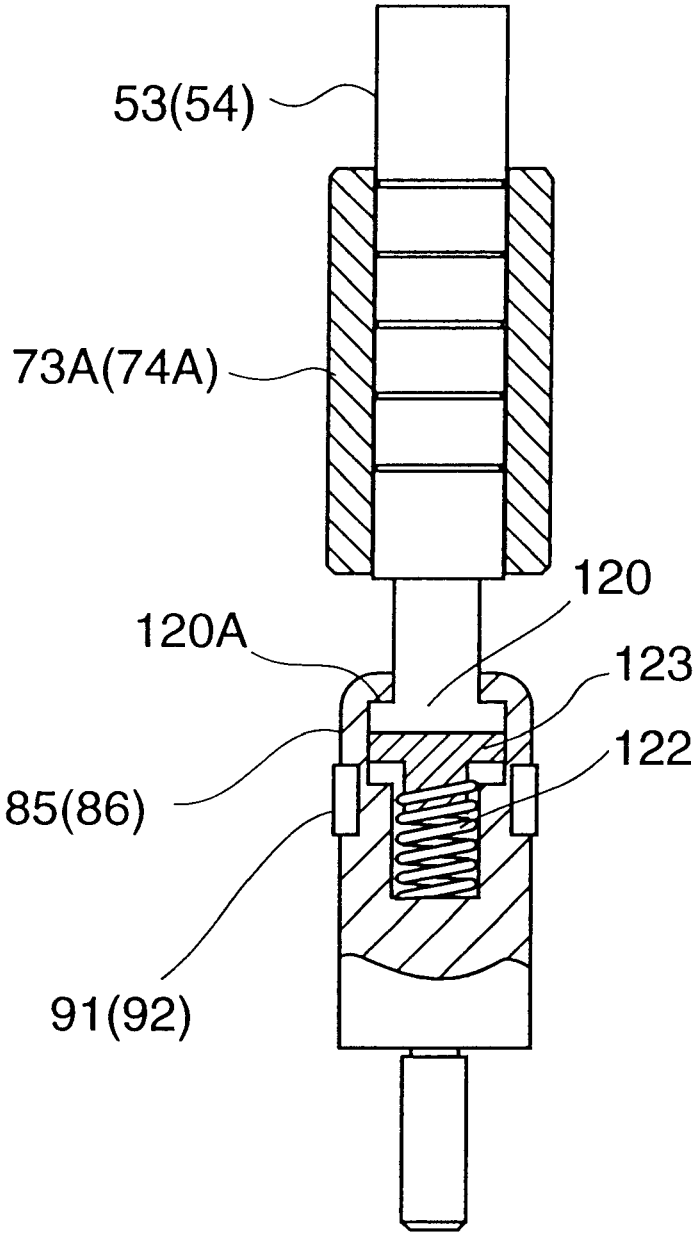
FIG. 21 is a schematic view of the piston of the connecting rod system according to another embodiment of the present invention with respect to the prior-art fourth constitution.

Next, the present invention with respect to the fourth constitution of the prior art is shown in FIGS. 20 and 21. First in FIG. 20, in the compression system high-pressure compressor 100 provided with the compression mechanism for reciprocating/driving the piston 53, 54 with respect to the cylinder 73, 74 by rotation of the motor and compressing the operating fluid sucked by the driving to generate the high-pressure operating fluid, the compression mechanism comprises a non-lubricating seal structure between the operation inner surface of the cylinder 73, 74, that is, the liner cylinder 73A, 74A and the piston 53, 54, and the piston 53, 54 is connected to a connecting rod 85, 86 by pressing a connecting flange portion 120 extended to the rear end of the piston 53, 54 in a connection space 121 formed in the connecting rod 85, 86 by a spring 122 so that the piston 53, 54 can oscillate with respect to the connecting rod 85, 86. This multistage compression apparatus of the high-pressure compressor is shown.

Therefore, by pressing the connecting flange portion 120 into the connection space 121 by the spring, a processing dimension error can be absorbed, a laborious processing for accurately maintaining a processing precision of an engagement/connection portion in the prior art is unnecessary, the necessity of the reinforcing material is obviated, and assembly is facilitated.

For oscillation of the piston 53, 54, an abutment surface 120A of the connecting flange portion 120 pressed onto the connecting rod 85, 86 has a spherical shape.

FIG. 21 shows another embodiment of the present invention. The embodiment is different from the constitution of FIG. 20 in that one end of a stable plate 123 for pressing the connecting flange portion 120 is inserted into the spring 122. This can stabilize the pressing of the connecting flange portion 120 by the spring 122.

For the present invention with respect to the fourth constitution of the prior art, the third compression section 103 and fourth compression section 104 are shown, but this is not limited within the technical scope of the present invention.

Figure 22:
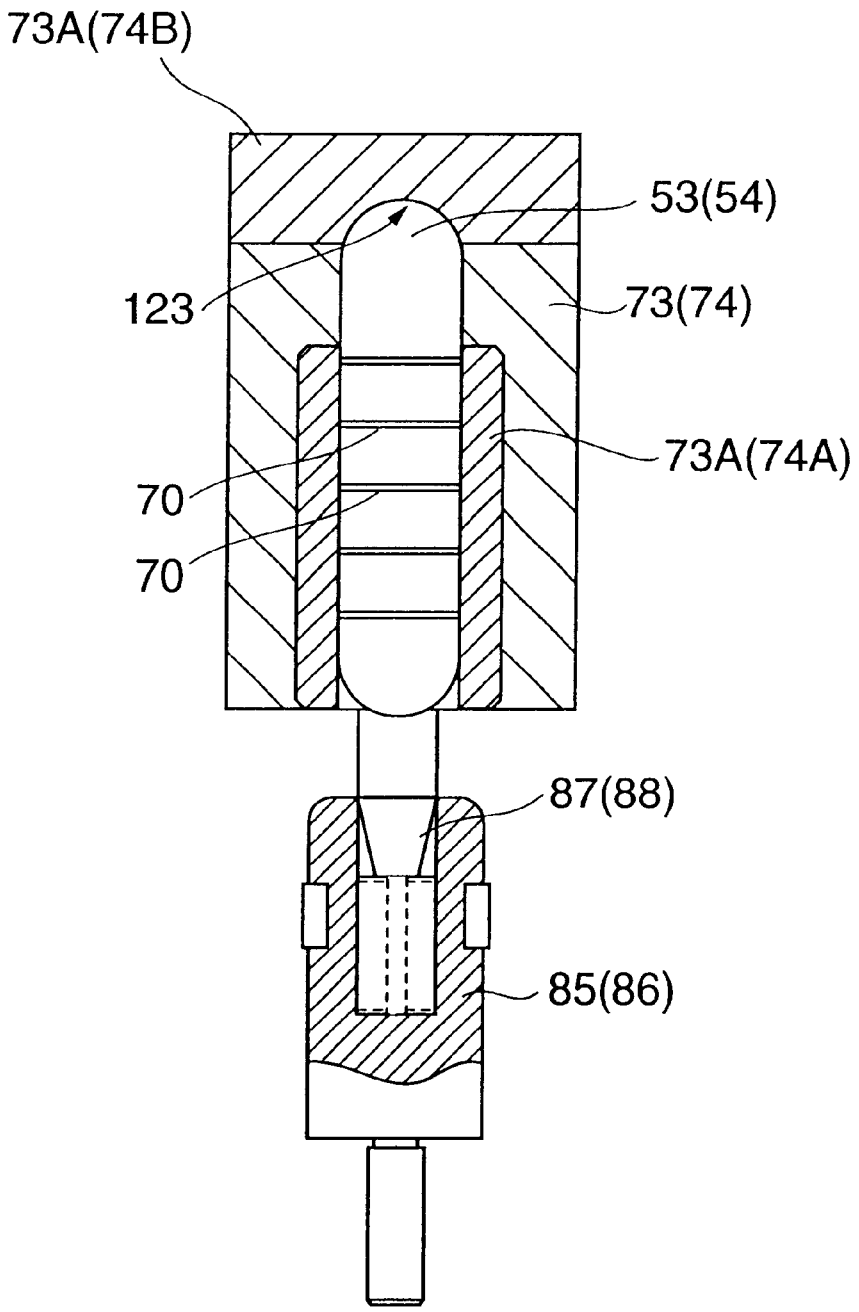
FIG. 22 is a schematic view of the compression section of the present invention with respect to the prior-art fifth constitution.

Next, the present invention with respect to the fifth constitution of the prior art is shown in FIG. 22. Specifically, in the compression type high-pressure compressor provided with the compression mechanism for reciprocating/driving the piston with respect to the cylinder 73, 74 by rotation of the motor and compressing the operating fluid sucked by the driving to generate the high-pressure operating fluid, the compression mechanism comprises a non-lubricating seal structure between the operation inner surface of the cylinder 73, 74, that is, the liner cylinder 73A, 74A and the piston 53, 54, and a protrusion shape of the tip end of the piston 53, 54 and an inner surface recess shape of a cylinder head 73B, 74B corresponding to the tip end are formed in a substantially identical R shape 123. The multistage compression apparatus of the high-pressure compressor characterized as described above is shown.

This prevents the phenomenon, caused in the prior art, in which the inner surface of the liner cylinder 73A, 74A is scraped by the downward displacement of the piston 53, 54, and reliability is enhanced. Moreover, a top clearance between the piston tip end and the cylinder head portion can be minimized, and compression performance can be enhanced.

For the present invention with respect to the fifth constitution of the prior art, the third compression section 103 and fourth compression section 104 are shown, but this is not limited within the technical scope of the present invention.

According to the present invention, there can be provided the multistage compression apparatus of the compression type high-pressure compressor in which prevention of wear of the inner surface of the liner cylinder, increase of the removal capacity, ease of processing, reduction of the top clearance and enhancement of properties, and the like can be realized.

Figure 25:
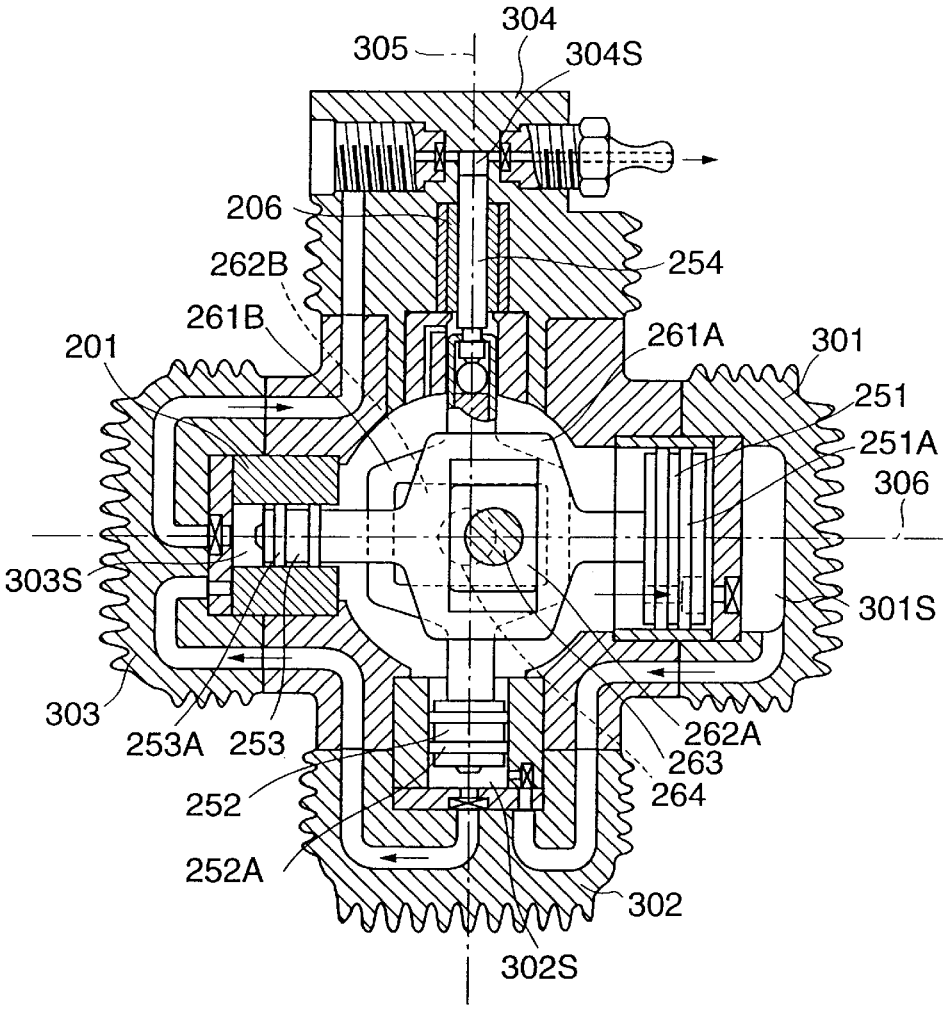
FIG. 25 is an explanatory view showing the structure of a four-stage compression apparatus.

The multistage compression apparatus as another embodiment will next be described. As this multistage compression apparatus, a four-stage compression apparatus is heretofore known and disclosed in U.S. Pat. No. 5,033,940, and the like, in which for example, as shown in FIG. 25, four reciprocating compression sections 301, 302, 303, 304 are arranged on axes 305, 306 crossing at right angles to each other so that the sections reciprocate, pressure is successively raised from the reciprocating compression section 301 and the reciprocating compression section 304 is used as a final-stage high-pressure compression section.

In the four-stage compression apparatus, a pair of opposite pistons 251, 253 are connected to a yoke 261A, and a cross slider 262A disposed movably to cross the axis 306 in the yoke 261A is connected to a crank shaft 264 via a crank pin 263. Moreover, another pair of opposite pistons 252, 254 are connected to a yoke 261B disposed with a deviation of 90 degrees from the yoke 261A, and a cross slider (not shown) disposed movably to cross the axis 305 in the yoke 261B is also connected to the crank shaft 264 via the crank pin 263.

Therefore, when the crank shaft 264 is rotated by an electric motor (not shown) to rotate the crank pin 263 around the crank shaft 264, the cross slider 262A moves to handle the displacement of the crank pin 263 of the direction of the axis 305 in the yoke 261A, the yoke 261A moves to handle the displacement of the direction of the axis 306, and a pair of pistons 251 and 253 therefore reciprocate only in the direction of the axis 306.

On the other hand, since in the yoke 261B the cross slider (not shown) moves to handle the displacement of the direction of the axis 306, the yoke 261B moves to handle the displacement of the direction of the axis 305, and a pair of pistons 252 and 254 therefore reciprocate only in the direction of the axis 305.

Figure 26:
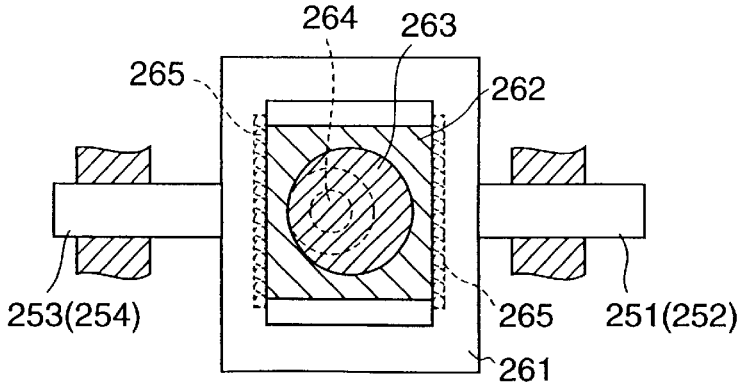
FIG. 26 is an explanatory view showing a driving mechanism of the four-stage compression apparatus shown in FIG. 25.

Moreover, in order to obtain a smooth reciprocating motion of the pistons 251, 252, 253, 254 from a constant-speed rotation of the crank shaft 264 through conversion, since the cross slider 262 needs to easily slide in the yoke 261, as shown in FIG. 26, a roller bearing 265 is interposed between the yoke 261 and the cross slider 262.

Moreover, in the piston 254 of the final-stage reciprocating compression section 304, a plunger piston provided with a labyrinth seal groove (not shown) on the surface is used, and piston rings 251A, 252A, 253A are fitted on the other reciprocating compression section pistons 251, 252, 253 to establish a seal with the cylinders.

However, when a bomb as a gas injection tank is charged, for example, with a nitrogen gas pressurized/compressed to a standard of 30 MPa by the four-stage compression apparatus constituted as described above, in the reciprocating compression section 303 for performing third-stage compression, the nitrogen gas of about 3 MPa needs to be pressurized/compressed to indicate about 10 MPa by the piston 253. However, the piston ring 253A of the piston 253 is worn, seal property in the reciprocating compression section 303 is deteriorated, and this causes problems: (1) a required high pressure is not obtained; and (2) a required amount of nitrogen gas cannot be supplied.

Specifically, in order to enhance the seal property, a resin piston ring of Teflon hard and superior in lubricating property or the like is used in the piston ring 253A, but the piston 253 reciprocates while the piston ring 253A is in contact with a cylinder 201 of the reciprocating compression section 303, and wear is therefore unavoidable. Therefore, when use time of the piston ring 253A increases, wear amount increases, a gap is made between the ring and the cylinder 201 of the reciprocating compression section 303, and the required high pressure cannot be obtained. With the high pressure, there is another problem that a large amount of gas leaks even from a slight gap and a required amount of supply cannot be secured, and it is therefore necessary to prevent the seal property in the third reciprocating compression section 303 from being deteriorated.

Then, the multistage compression apparatus which can solve the aforementioned conventional-art problem will be described with reference to FIGS. 23 to 26.

Figure 23:
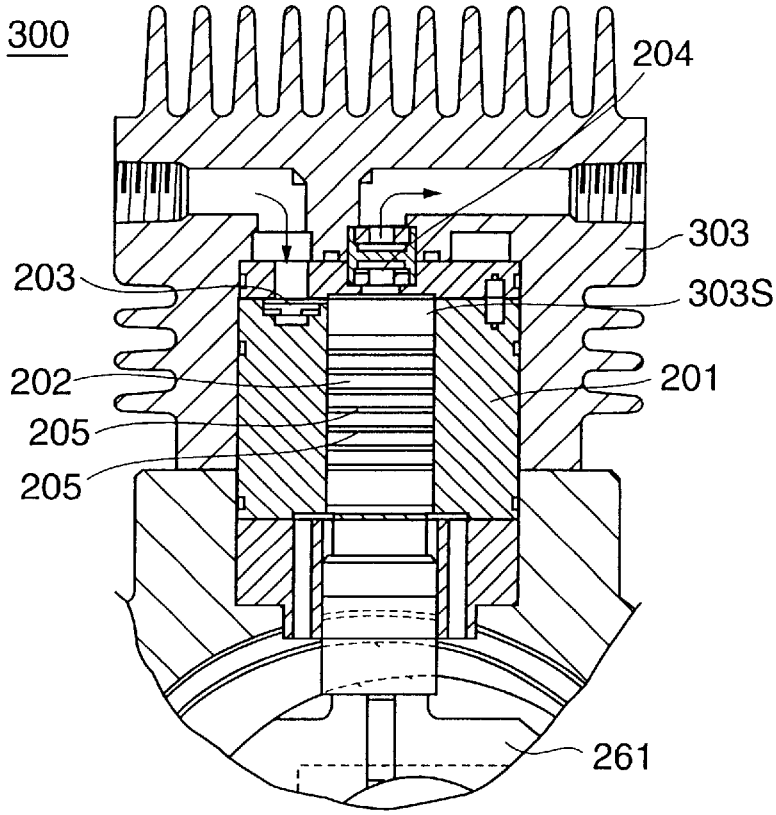
FIG. 23 is an explanatory view showing a main part of still another embodiment.
Figure 24:
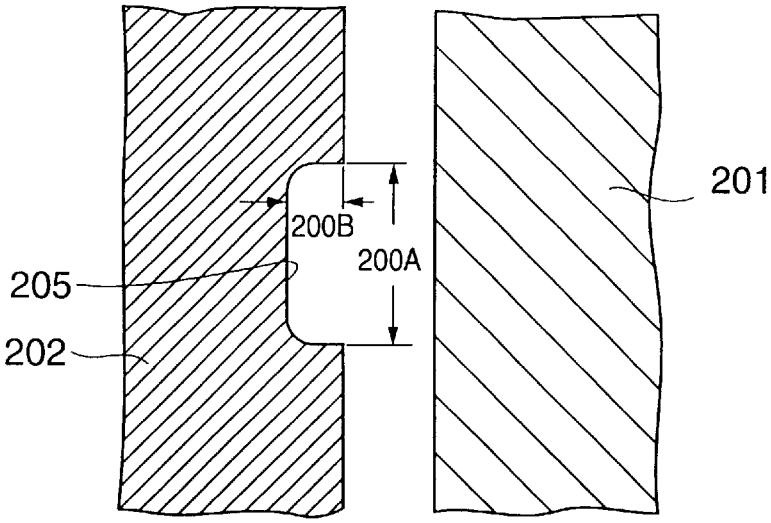
FIG. 24 is an explanatory view showing a part of FIG. 23 in an enlarged manner.

FIG. 23 is an explanatory of the third reciprocating compression section 303 in a four-stage compression apparatus 300 of the present invention for the nitrogen gas. A plunger piston 202 reciprocates/operates inside the cylinder 201 to compress the nitrogen gas sucked into a compression chamber 303S.

Additionally, the compression chamber 303S is connected to a compression chamber 302S of the second reciprocating compression section 302 via a valve mechanism 203 when the plunger piston 202 moves backward and operates to enlarge a capacity of compression chamber 303S, and connected to a compression chamber 304S of the fourth reciprocating compression section 304 via a valve mechanism 204 when the plunger piston 202 moves forward and operates to reduce the capacity of the compression chamber 303S (this operation will be hereinafter referred to as compressing operation).

Moreover, the cylinder 201 and plunger piston 202 are formed so that the gap of the diametric direction is entirely in a range of 3 to 10 $\mu$m, pressure loss in the compression chamber 303S during the compressing operation of the plunger piston 202 is prevented, and the amount of gas leaking from the gap between the cylinder 201 and the plunger piston 202 is reduced to prevent the amount of gas supplied to the compression chamber 304S of the reciprocating compression section 304 from being insufficient.

The gap of the diametric direction between the cylinder 201 and the plunger piston 202 is preferably small in view of the pressure loss. However, when the gap between the cylinder 201 and the plunger piston 202 formed with a diameter of about 22 mm (additionally, the diameter of the reciprocating compression section 301 is 78 mm, and that of the reciprocating compression section 302 is 39 mm) is set to be smaller than 3 $\mu$m, a high precision is required and a manufacture cost disadvantageously increases. Additionally, even with a gap of 3 $\mu$m or more the pressurizing/compressing to a predetermined pressure of 30 MPa is sufficiently possible by compression in the fourth reciprocating compression section 304, and the gap may therefore be 3 $\mu$m or more.

On the other hand, even when a labyrinth seal groove 205 is disposed on the surface of the plunger piston 202 as described later, with a large gap of 10 $\mu$m or more between the cylinder 201 and the plunger piston 202, the amount of gas leaking from the gap becomes too large and the amount of gas supplied to the compression chamber 304S of the fourth reciprocating compression section 304 becomes insufficient. Additionally, the gas cannot be pressurized to a predetermined pressure of about 10 MPa and supplied to the compression chamber 304S.

Therefore, the cylinder 201 and plunger piston 202 are formed so that the gap of the diametric direction is in a range of 3 to 10 $\mu$m as described above.

Moreover, several, for example, seven labyrinth seal grooves 205 are disposed on the surface of the plunger piston 202 at intervals of 4 mm, so that seal effect is enhanced.

Each labyrinth seal groove 205 is disposed so that a depth 200B is in a range of 0.2 to 0.5 mm, width 200A is 1.0 mm, and a ratio of depth 200B/width 200A is in a range of 0.2 to 0.5.

When the ratio of depth 200B/width 200A is less than 0.2, a pressure fluctuation inside the groove is small, eddy does not easily occur and the seal property is disadvantageously deteriorated. When the ratio exceeds 0.5, a flow reducing effect decreases, and the seal property disadvantageously becomes equal to that in a case in which there is no groove. Therefore, the labyrinth seal groove 205 is disposed so that the ratio of depth 200B/width 200A is in a range of 0.2 to 0.5.

On the other hand, a cylinder 206 constituting the fourth reciprocating compression section 304 and the plunger piston 254 for reciprocating/operating inside the cylinder to pressurize/compress the nitrogen gas sucked in the compression chamber 304S are formed so that the gap of the diametric direction is entirely in a range of 2 to 8 μm (see FIG. 25).

The gap of the diametric direction between the cylinder 206 and the plunger piston 254 is preferably small in view of the pressure loss. However, when the gap between the cylinder 206 and the plunger piston 254 formed with a diameter of about 13 mm is set to be smaller than 2 μm, the high precision is required and the manufacture cost disadvantageously increases. Additionally, even with a gap of 2 μm or more the nitrogen gas pressurized/compressed to about 10 MPa and supplied from the reciprocating compression section 303 can sufficiently be pressurized/compressed to provide a predetermined pressure of 30 MPa, and the gap may therefore be 2 μm or more.

However, when a gap larger than 8 μm is present between the cylinder 206 and the plunger piston 254, even with the labyrinth seal groove disposed on the surface of the plunger piston 254, the amount of gas leaking from the gap becomes too large, the nitrogen gas cannot be pressurized/compressed to the predetermined pressure of about 30 MPa, and it is disadvantageously impossible to supply a predetermined amount of high-pressure nitrogen gas within a predetermined time.

Therefore, the cylinder 206 and plunger piston 254 are formed so that the gap of the diametric direction is in a range of 2 to 8 μm as described above.

Moreover, several labyrinth seal grooves (not shown) are also disposed on the surface of the plunger piston 254, so that the seal effect with the cylinder 206 is enhanced.

Furthermore, by setting the gap of the diametric direction between the cylinder 206 of the fourth reciprocating compression section 304 and the plunger piston 254 to be smaller than the gap between the cylinder 201 of the third reciprocating compression section 303 and the plunger piston 202, the pressure loss and the increase of the amount of leaking gas are prevented.

Additionally, other constitutions are substantially the same as those of the conventional multistage compression apparatus shown in FIGS. 25, 26.

Therefore, according to the four-stage compression apparatus of the present invention constituted as described above, when the nitrogen gas is successively pressurized/compressed in the compression chamber 301S of the reciprocating compression section 301, the compression chamber 302S of the reciprocating compression section 302, the compression chamber 303S of the reciprocating compression section 303, and the compression chamber 304S of the reciprocating compression section 304 to charge the bomb for gas injection or the like, during the pressurizing/compressing in the compression chamber 303S of the reciprocating compression section 303 and the compression chamber 304S of the reciprocating compression section 304 having reached the high pressure, the amount of nitrogen gas leaking from the gap between the cylinder and plunger piston is reduced, the predetermined high pressure is easily obtained, and charging time is shortened.

Additionally, since the present invention is not limited to the aforementioned embodiment, various modifications are possible without departing from the scope defined in the appended claims.

As described above, according to the multistage compression apparatus of the present invention, the gas leak mainly in the latter-stage compression section in which the predetermined high pressure is obtained can be prevented, and therefore the nitrogen gas can quickly be pressurized/compressed, for example, to a high pressure of 30 MPa and supplied.

The multistage compression apparatus as still another embodiment will next be described. For the multistage compression apparatus, in the conventional art, when the gas bomb of a natural gas car is charged with operating fluids such as a natural gas, the operating fluid is compressed to the high pressure by the multistage compression apparatus and the charging is performed.

Figure 31:
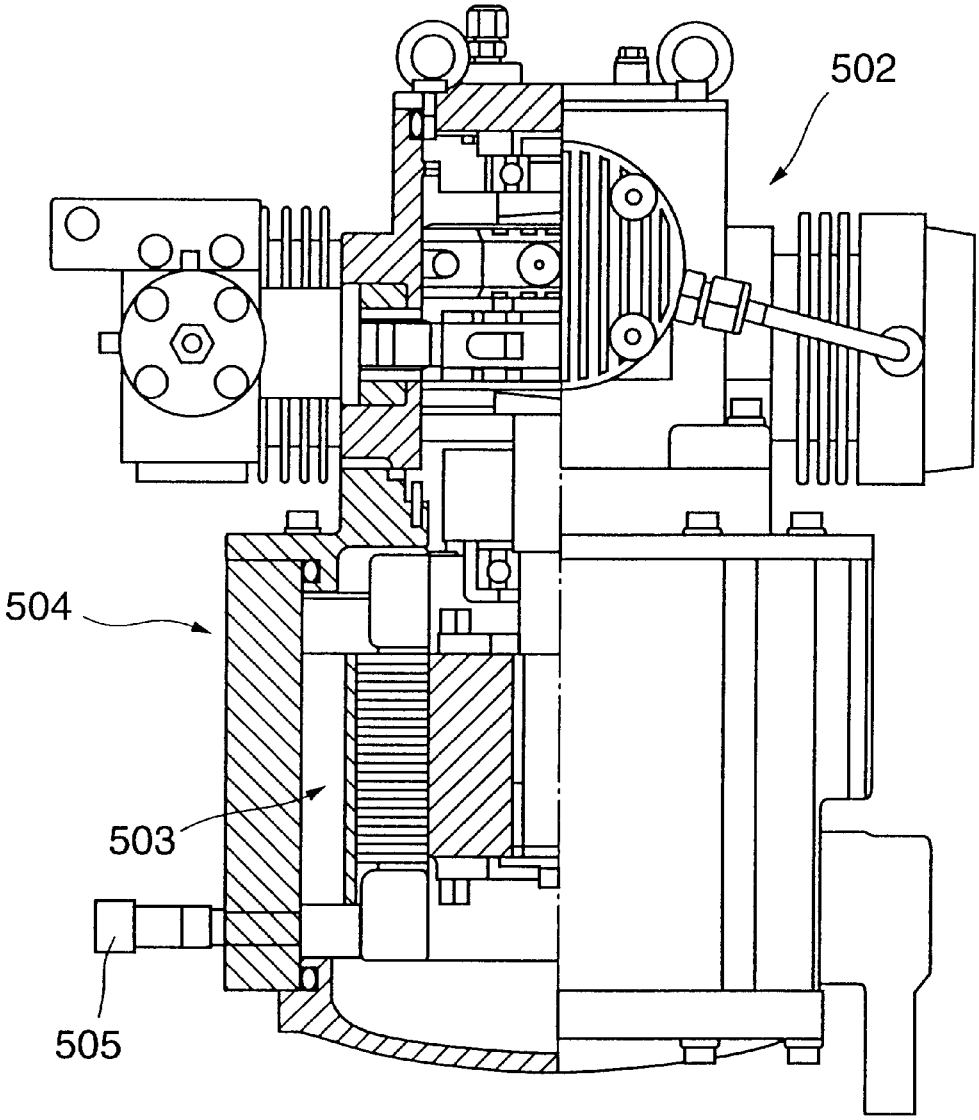
FIG. 31 is a partially broken side view of the multistage compression apparatus showing a conventional art.
Figure 32:
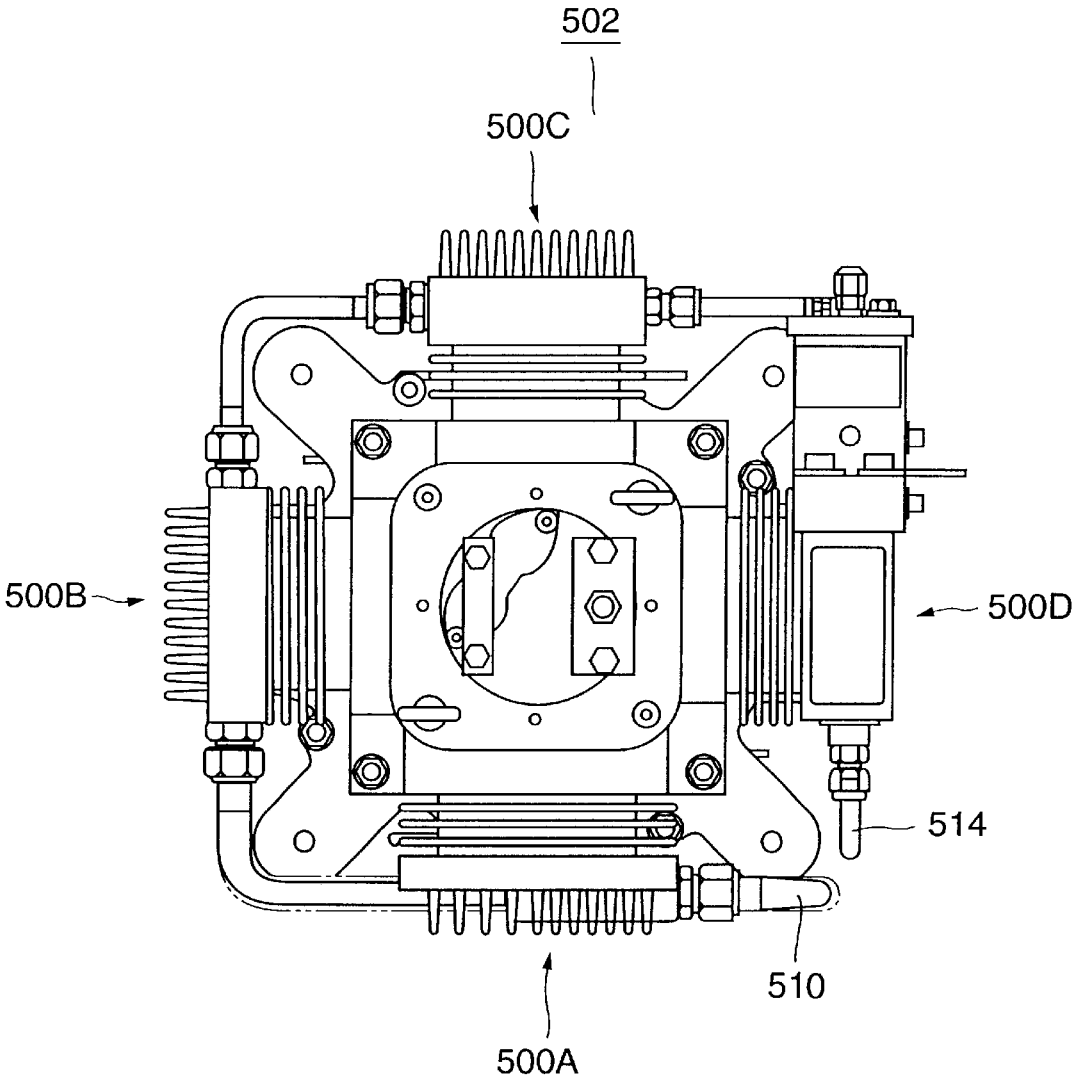
FIG. 32 is a top plan view of FIG. 31.

Various constitutions are proposed with respect to the multistage compression apparatus, and a constitution shown in FIG. 31 is one of the proposals. Additionally, FIG. 32 is a top plan view.

In the multistage compression apparatus, compression means 502 is disposed in an upper part, and driving means 503 contained in a sealed case 504 is disposed in a lower part.

A space in the case 504 is connected to a back pressure chamber in the compression means 502. The operating fluid sucked via an inlet port 510 is compressed in the compression chamber and discharged to the outside of the apparatus via a discharge port 514.

The compression means 502 is constituted of first to fourth compression sections 500A, 500B, 500C, 500D for compressing the operating fluid, and disposed in a cross position. Additionally, the first to fourth compression sections 500A to 500D are provided with first to fourth pistons (not shown), respectively.

The operating fluid is compressed in the first compression section 500A and fed to the second compression section 500B, and compressed in the second compression section 500B and fed to the third compression section 500C. The operating fluid is successively compressed in this manner and fed to the fourth compression section 500D, and finally compressed in the fourth compression section 500D and discharged from the discharge port 514.

In this case, when the operating fluid of each compression chamber flows to the side of the back pressure chamber via the space between the piston and the piston cylinder for containing the piston, the compression efficiencies of the respective compression sections 500A to 500D are deteriorated.

Additionally, in the following description, the space between the piston and the piston cylinder is referred to as a clearance, and the operating fluid flowing to the side of the back pressure chamber through the clearance is referred to as a piston leak. Therefore, the piston leak flows along the side surface (sliding surface) of the piston.

Figure 33:
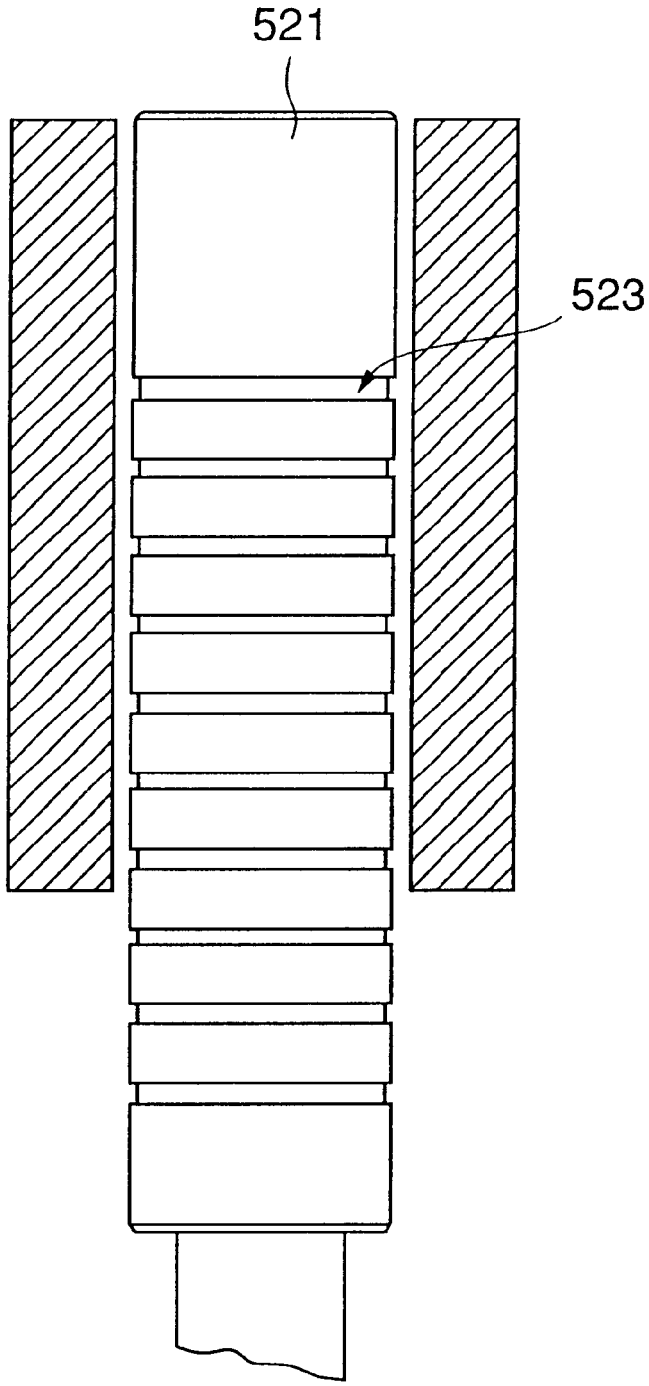
FIG. 33 is a side view of the fourth piston.

In this case, the first to third pistons are provided, for example, with contact type seals such as an O ring, and a fourth piston 521 of a final stage is provided with a labyrinth seal 523 as a non-contact type seal as shown in FIG. 33 so that the piston leak is inhibited.

The labyrinth seal 523 shown in FIG. 33 is an annular groove (hereinafter referred to as a labyrinth groove) with a groove depth of about several hundreds of microns formed in the sliding surface of the fourth piston 521, and a plurality of labyrinth grooves are formed at equal intervals to enhance the seal property.

On the other hand, a relief valve 505 is attached to the side surface of the case 504. The relief valve 505 is disposed to avoid the following unexpected situation. The pressure in the case 504 sometimes becomes abnormally high for an unexpected reason. If this state is left to stand, the case 504 is deformed or cracked.

Specifically, when the pressure in the case 504 reaches the predetermined pressure, the relief valve 505 is opened to prevent the aforementioned unexpected situation.

However, in order to enhance the seal property of the labyrinth seal 523, it is necessary to increase the number of labyrinth grooves and to increase a forming density of labyrinth grooves, but when the number of labyrinth grooves and the density of the labyrinth grooves are increased, there is a problem that a labyrinth groove forming cost raises a product cost.

Moreover, since the labyrinth grooves are disposed at equal intervals, the length of the fourth piston 521 necessarily determines the number of labyrinth grooves which can be formed, and it is disadvantageously difficult to achieve a higher seal property.

On the other hand, when the multistage compression apparatus is used for a long time, the contact type seals such as the O ring disposed on the first to third pistons and the movable portion of the piston shaft are gradually worn, and moisture contained in the operating fluid is condensed and formed into waterdrops in some cases.

Since the worn powder, waterdrops, and the like are accumulated in the bottom of the case 504, to remove these the multistage compression apparatus has to be disassembled/cleaned, which raises a problem in ease of maintenance.

Figure 27:
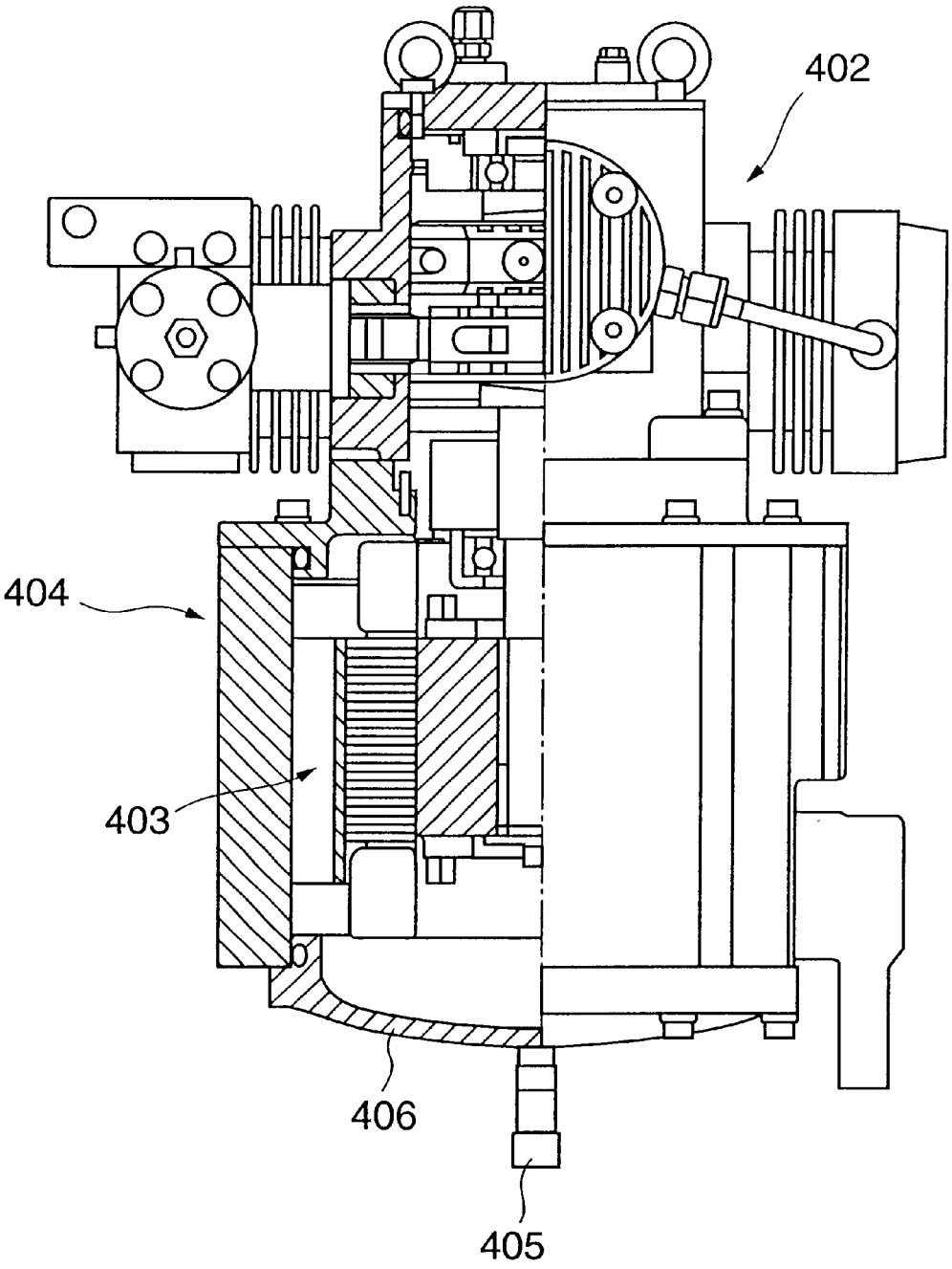
FIG. 27 is a partially broken side view of the multistage compression apparatus showing still another embodiment.
Figure 28:
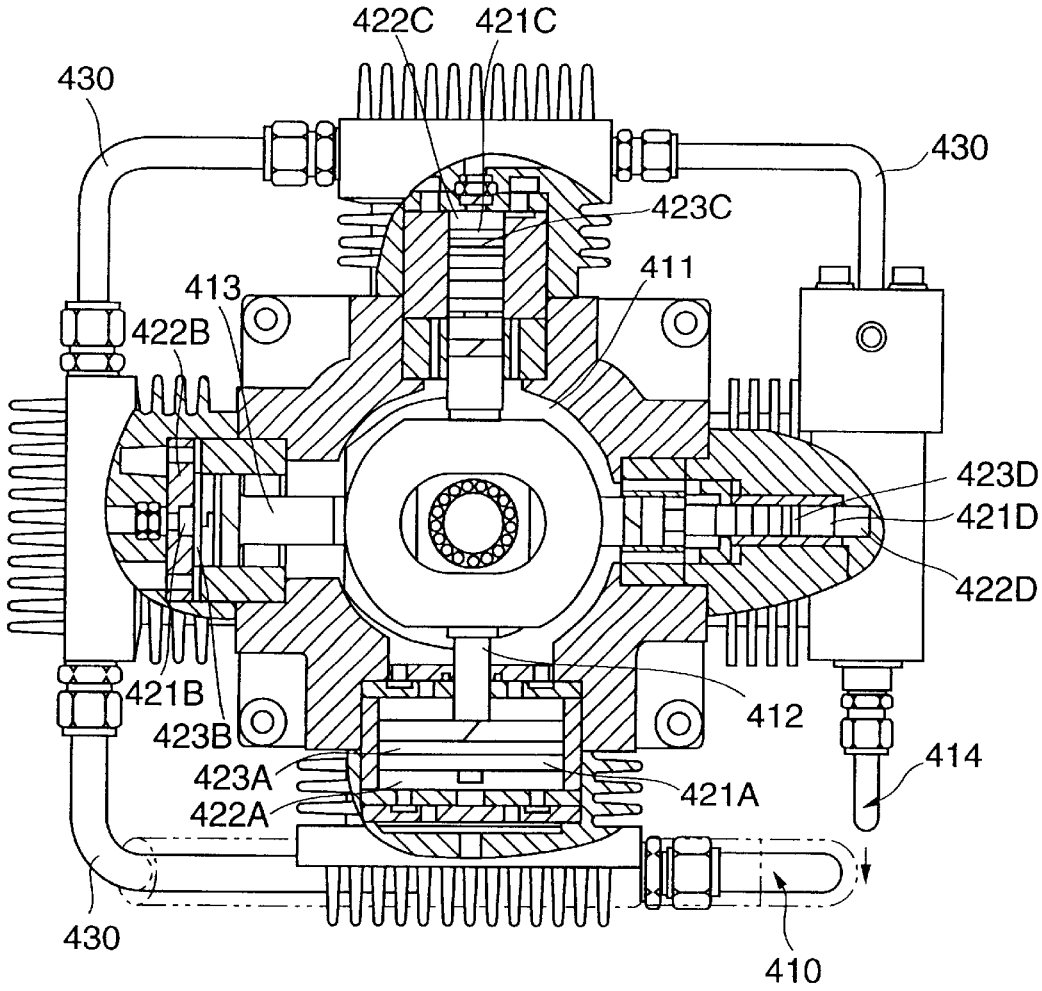
FIG. 28 is a horizontal sectional view of compression means.
Figure 29:
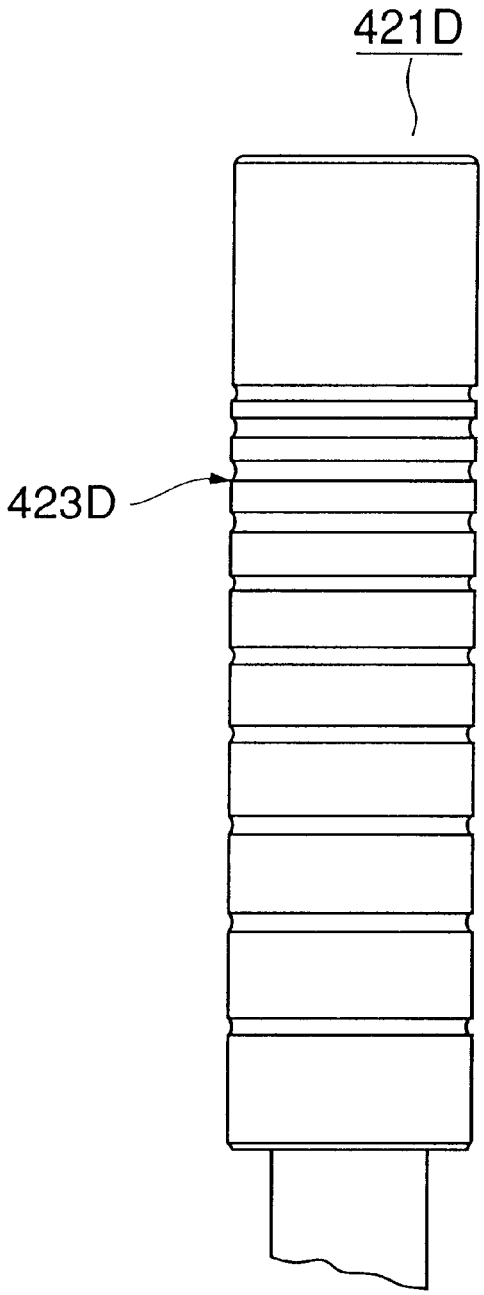
FIG. 29 is a side view of a fourth piston.

To solve the problem, according to the present invention, there is provided a multistage compression apparatus in which the piston leak can more efficiently be reduced without increasing the number of labyrinth grooves, and the maintenance is easily performed. The apparatus will be described with reference to FIGS. 27 to 30. FIG. 27 is a partially broken side view of the multistage compression apparatus of the present invention, FIG. 28 is a horizontal sectional view of the compression means, and FIG. 29 is a side view of the fourth piston.

In the multistage compression apparatus, compression means 402 is disposed in an upper part, and driving means 403 contained in a sealed case 404 is disposed in a lower part.

The operating fluid such as the natural gas supplied via a suction port 410 is supplied to a space in the case 404, and the space in the case 404 is connected to a back pressure chamber 411 which also serves as an operating fluid supply chamber in the compression means 402.

Subsequently, the operating fluid supplied to the compression chamber from the back pressure chamber 411 is compressed in the compression chamber and discharged to the outside of the apparatus via a discharge port 414.

Additionally, a bottom 406 of the case 404 is provided with a relief valve 405 in a vertical downward direction.

The compression means 402 is constituted by disposing first to fourth compression sections A to D for compressing the operating fluid in a cross position, and the first to fourth compression sections A to D are provided with first to fourth pistons 421A to 421D, respectively.

The first piston 421A is connected to the third piston 421C via a piston shaft 412, the second piston 421B is connected to the fourth piston 421D via a piston shaft 413, and the respective pistons cooperatively operate to reciprocate in the same direction.

The piston shafts 412, 413 are disposed on the side of the back pressure chamber 411 of the respective pistons 421A to 421D.

The first piston 421A is provided with a suction port (not shown) for connecting the back pressure chamber 411 to a first compression chamber 422A, and a suction side check valve (not shown) is disposed midway in the suction port.

Moreover, respective compression chambers 422A to 422D are connected via a connecting pipe 430, and the connecting pipe 430 is provided with suction and discharge side check valves (not shown).

Phases of the respective pistons 421A to 421D are delayed every 45 degrees toward the later-stage compression section like the first compression section A→second compression section B→compression section C→fourth compression section D, and diameters of the respective pistons 421A to 421D are reduced toward the later stage. Therefore, the respective compression chambers 422A to 422D are also reduced in size.

Moreover, when the first piston 421A moves toward the back pressure chamber 411, the suction side check valve opens, the operating fluid on the side of the back pressure chamber 411 is taken into the first compression chamber 422A and compressed. Of course, the suction side check valve is closed during compression.

Therefore, the operating fluid is compressed by the first compression section A and fed to the second compression section B, and compressed in the second compression section B and fed to the third compression section C. The operating fluid is successively compressed in this manner and fed to the fourth compression section D, and finally compressed in the fourth compression section D and discharged from the discharge port 414.

In this case, in order to inhibit the piston leak caused when the operating fluid of each of the compression chambers 422A to 422D flows via the clearance, the first, second pistons 421A, 421B are provided, for example, with contact type seals 423A, 423B such as O rings, and the third, fourth pistons 421C, 421D are constituted of plunger pistons provided with labyrinth seals 423C, 423D as shown in FIG. 29.

The labyrinth seal 423D of the fourth piston 421D shown in FIG. 29 is formed on the sliding surface of the fourth piston 421D and is a labyrinth groove formed of an annular groove with a groove depth of about several hundreds of microns, and the density of labyrinth grooves is reduced toward the side of the back pressure chamber 411 from the side of the fourth compression chamber 422D.

Additionally, in the present specification, a uniform density of labyrinth grooves is referred to as "equal pitch", and the density with a change is referred to as "irregular pitch".

Figure 30:
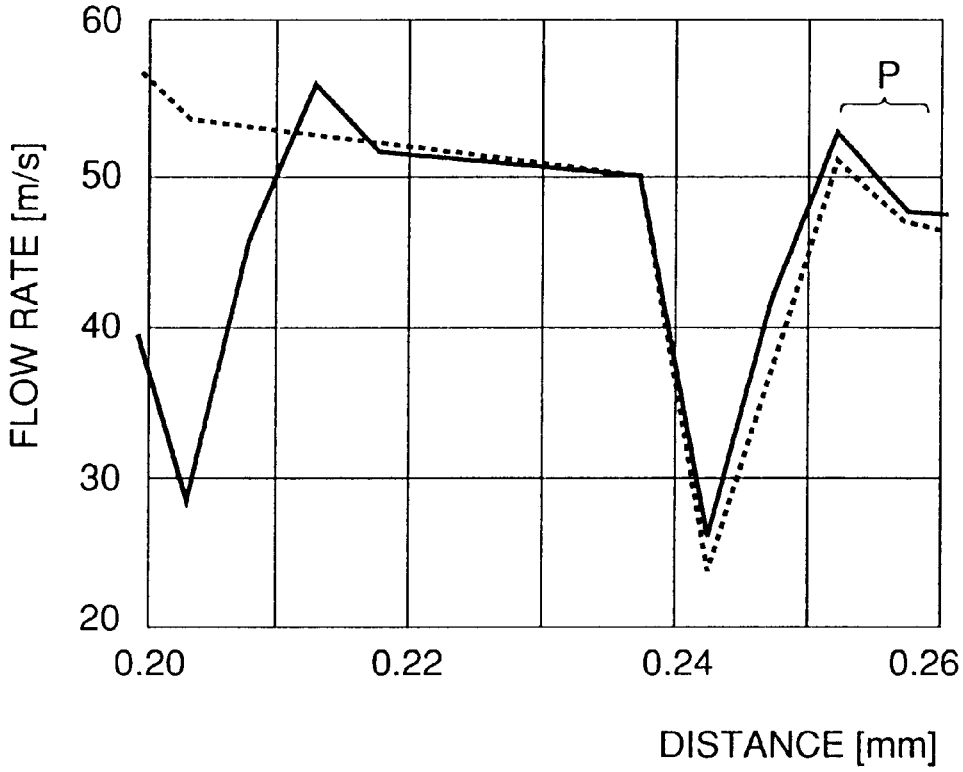
FIG. 30 is a diagram showing leak properties when labyrinth grooves are formed at equal pitches and irregular pitches.

FIG. 30 is a chart showing comparison of the seal property between the equal pitch (solid line) and the irregular pitch (dotted line) when the number of labyrinth grooves is the same, the ordinates indicates a flow rate of the operating fluid, and the abscissa indicates a distance of the fourth compression chamber 422D from a piston operation surface. In the present embodiment, the pitch interval indicates a coarse density in arithmetical series toward the side of the back pressure chamber 411 from the side of the fourth compression chamber 422D.

The labyrinth groove closest to the side of the back pressure chamber 411 has an unevenness of about 0.242 mm, and an area P in FIG. 30 indicates the flow rate in a clearance area between the labyrinth groove and the back pressure chamber 411.

It is seen from FIG. 30 that with the irregular pitch the flow rate can be reduced at least in the area P. Additionally, since the clearance is the same in either the equal pitch or the irregular pitch, the reduction of the flow rate means the Inhibition of the piston leak.

The irregular pitch inhibits the piston leak in this manner supposedly for the following reason.

The leak is usually generated when the operating fluid flows to a low pressure side from a high pressure side, and a leak amount is substantially defined by a pressure difference and conductance. Specifically, even in the same leak path, when the pressure difference is large, the leak amount increases. Moreover, even with the same pressure difference, when the conductance is small, the leak amount increases.

In the present invention, the pressure difference indicates a difference pressure between the fourth compression chamber 422D and the back pressure chamber 411. Moreover, the conductance can be interpreted as an inverse number of flow resistance when the operating fluid flows to the back pressure chamber 411 from the fourth compression chamber 422D, and to reduce the conductance the number of labyrinth grooves or the density may be increased.

Moreover, the labyrinth seal 423D is constituted when the operating fluid flowing through the clearance is expanded in the labyrinth groove, the pressure difference from the adjacent labyrinth groove on the low pressure side is reduced and this depresses the flow rate of the operating fluid.

Therefore, it is interpreted that by increasing the density of labyrinth grooves on the side of the fourth compression chamber 422D as compared with that on the side of the back pressure chamber 411, pressure drop is efficiently (rapidly) generated in the high density area and the piston leak is inhibited.

This means that the conductance of the fourth compression chamber 422D and back pressure chamber 411 substantially becomes small, and it is seen that the effect similar to the effect obtained by increasing the number and forming density of the labyrinth grooves can be obtained by the aforementioned irregular pitch.

Moreover, also when the plunger piston is used in the third compression chamber, the similar effect can be obtained using the labyrinth seal with the similar irregular pitch.

The maintenance of the multistage compression apparatus constituted as described above will next be described. The multistage compression apparatus is provided with a plurality of movable portions as described above, with the operation the movable portions are worn and the worn powder is accumulated in the bottom 406 of the case 404. Moreover, when the operating fluid contains moisture, the moisture is condensed in the case 404 to form waterdrops, and accumulated in the bottom of the case 404. Furthermore, in the conventional art these are removed by disassembling/cleaning.

In the present invention, however, the relief valve 405 is disposed in the bottom 406 of the case 404 and directed downward. Therefore, when the worn powder, and the like are accumulated, the pressure in the case 404 is manually raised to open the relief valve 405, and the worn powder, and the like are discharged together with the operating fluid to the outside of the apparatus.

Of course, when the pressure in the case 404 abnormally rises for the unexpected reason, the relief valve 405 is also opened, and needless to say, the worn powder, and the like are discharged to the outside of the apparatus.

Therefore, the inside of the case 404 can be cleaned without disassembling the case and a maintenance property is considerably enhanced.

Additionally, in the above description, it is premised that the multistage compression apparatus is constituted of an oil-less mechanism, but the present invention is not limited to this.

In this case, by disposing the relief valve 405 on the bottom 406, when the relief valve 405 is opened, oil is discharged to the outside of the apparatus, which produces a fear that the outside of the apparatus is contaminated and oil is wasted.

To solve the problem that the outside of the apparatus is contaminated, a storage tank (not shown) for storing the oil discharged from the relief valve 405 may separately be disposed.

Moreover, the problem that the oil is wasted is essentially nonsense as described later. Specifically, when the oil containing the worn powder, and the like is continuously used as a lubricant, the worn powder adheres to the movable portion and, for example, a serious trouble that the piston is locked occurs. Therefore, even during disassembling/cleaning the oil has to be changed.

As described above, since the forming density of labyrinth grooves is reduced toward the side of the back pressure chamber from the side of the compression chamber, the seal property can efficiently be enhanced.

Moreover, since the relief valve is disposed in the bottom of the sealed case, the worn powder of the movable portion, and the like can be discharged to the outside of the apparatus via the relief valve without disassembling/cleaning the apparatus, and the maintenance property is enhanced.

The multistage compression apparatus as still another embodiment will next be described. As the multistage compression apparatus, in a conventional constitution, with an increase of the number of compression stages, the reciprocating compression sections, that is, the compression sections formed by cylinders and pistons are disposed so that diameters of the cylinder and piston are reduced toward the high pressure side, and are arranged in an L type, V type, W type, semi-star type, star type, opposite balance type, and the like, and the respective compression sections are cooperatively connected via the crank shaft so that the sections operate in strokes deviating by the required phase to perform a multistage compressing operation in a mechanism. A constitution for operating this mechanism by driving sources such as an electric motor is disclosed (FIGS. 30 to 32, and the like of the tenth edition of "Mechanical Engineering Handbook" by the Japan Society of Mechanical Engineers as of Sep. 15, 1970).

Figure 42:
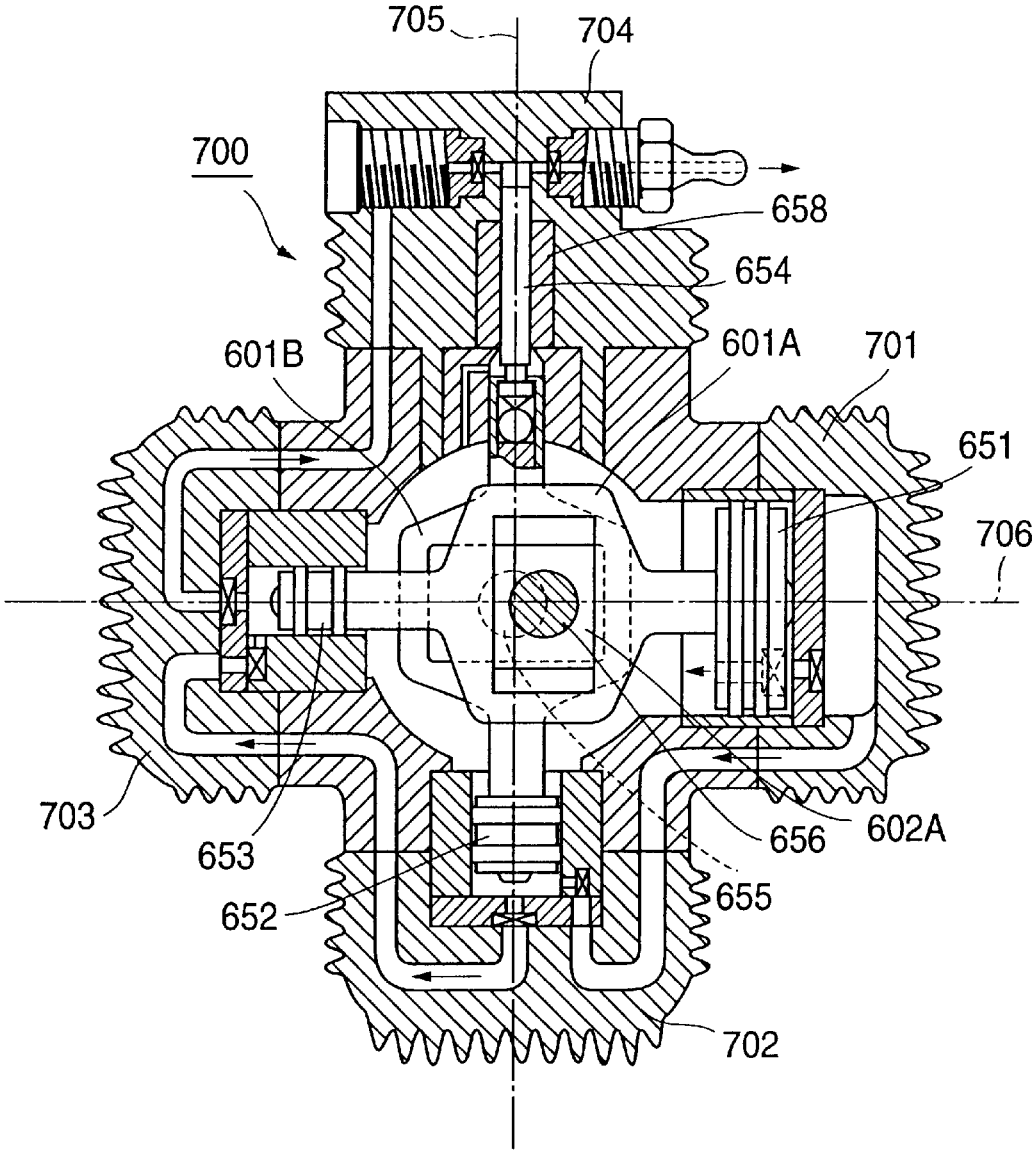
FIG. 42 is an explanatory view showing a section of a conventional multistage compression apparatus.

Moreover, as shown in FIG. 42, a conventional multistage compression apparatus 700 is known in which four reciprocating compression sections 701, 702, 703, 704 are arranged on axes 705, 706 crossing at right angles to each other so that the sections reciprocate/cooperate, the pressure is successively raised from the reciprocating compression section 701 and the reciprocating compression section 704 is used as the high-pressure compression section of the final stage.

Moreover, in the multistage compression apparatus 700, a pair of opposite pistons 651, 653 are connected to a yoke 601A, another pair of opposite pistons 652, 654 are connected to a yoke 601B which deviates from the yoke 601A by 90 degrees, a crank shaft 655 is rotated by an electric motor of an electromotive section (not shown) to rotate a crank pin 656 around the crank shaft 655, the pair of pistons 651, 653 are reciprocated only in the direction of the axis 706, and the other pair of pistons 652, 654 are reciprocated only in the direction of the axis 705. In this example, the fourth reciprocating compression section 704 is constituted by a plunger pump.

In the conventional constitution, the reciprocating compression section 704 is constituted by inserting the piston 654 into the cylinder 658. Since the cylinder 658 is formed of ceramic in view of a linear expansion coefficient, surface finishing, and the like, there is a problem that pressure resistant strength is weak. As additional problems, vibration occurs, the cylinder 658 moves and is damaged, gap precision between the cylinder 658 and the piston 654 is deteriorated and performance and reliability are deteriorated.

Then, according to the present invention, with respect to the multistage compression apparatus in which at least one reciprocating compression section for compressing required gasses such as the nitrogen gas in multiple stages to the high pressure is constituted by the plunger pump, there is provided a multistage compression apparatus in which the pressure resistant strength of the cylinder of the plunger pump is enhanced to solve the conventional plunger pump problems that the vibration occurs, the cylinder moves and is damaged, the gap precision between the cylinder and the piston is deteriorated and the performance is deteriorated, so that the durability and reliability are enhanced. Moreover, with respect to the piston (e.g., piston 51) provided with the piston ring and guide ring, there is provided a multistage compression apparatus in which PV value of the piston ring or the guide ring is reduced, mechanical loss is reduced, and reliability is enhanced.

Figure 34:
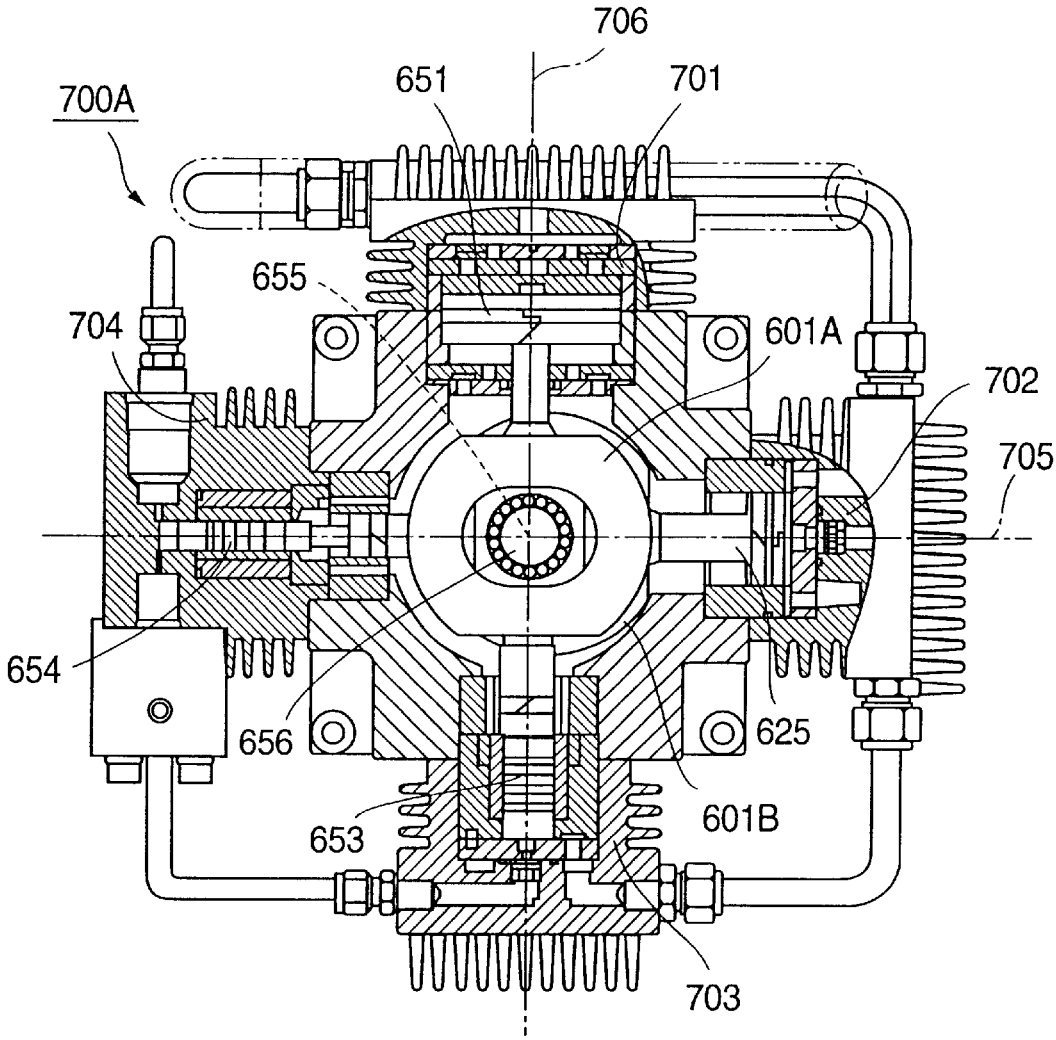
FIG. 34 is an explanatory view showing a section of still another embodiment of the multistage compression apparatus of the present invention.

The embodiment of the present invention will be described hereinafter with reference to FIGS. 34 to 40. FIG. 34 is an explanatory view showing a section of still another embodiment of the multistage compression apparatus of the present invention, FIG. 35 is an explanatory view showing a section of the fourth reciprocating compression section (plunger pump) of the multistage compression apparatus of the present invention shown in FIG. 34, and FIG. 36 is an explanatory view showing a section of the third reciprocating compression section (plunger pump) of the multistage compression apparatus of the present invention shown in FIG. 34.

Additionally, in these drawings the components denoted by the same reference numerals as those of FIG. 42 have functions similar to those described in the related art, and the description thereof is omitted as long as understanding of the present invention is not hindered.

Figure 35:
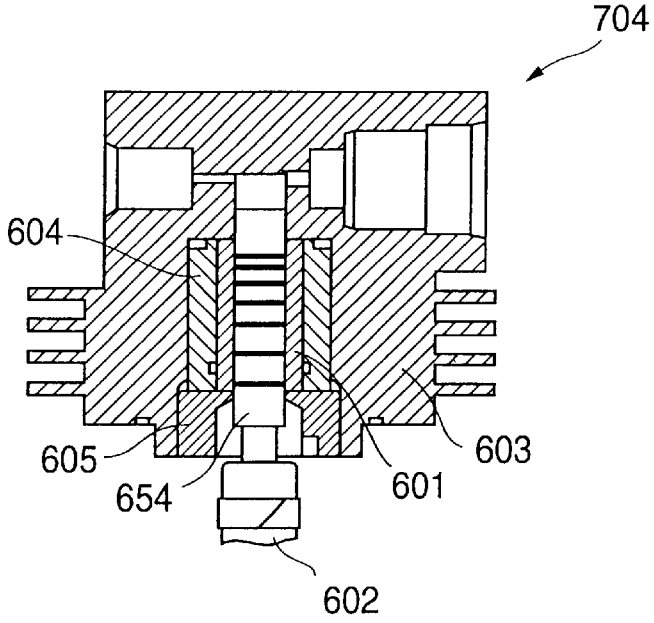
FIG. 35 is an explanatory view showing a section of the embodiment of a fourth reciprocating compression section of the multistage compression apparatus of the present invention shown in FIG. 34.

As shown in FIG. 35, the fourth reciprocating compression section (plunger pump) 704 of a multistage compression apparatus 700A of the present invention shown in FIG. 34 is constituted of the piston 654 inserted into a ceramic cylinder liner 601, a connecting rod 602 connected to the piston 654 (connecting rod for connecting the piston 654 to the yoke 601B), and the like, and a sleeve 604 is interposed as the pressure resistant structure member between the cylinder liner 601 and a plunger pump main body 603. Moreover, the cylinder liner 601 and sleeve 604 are fixed by screwing a fixing bolt 605 into the plunger pump main body 603.

Figure 36:
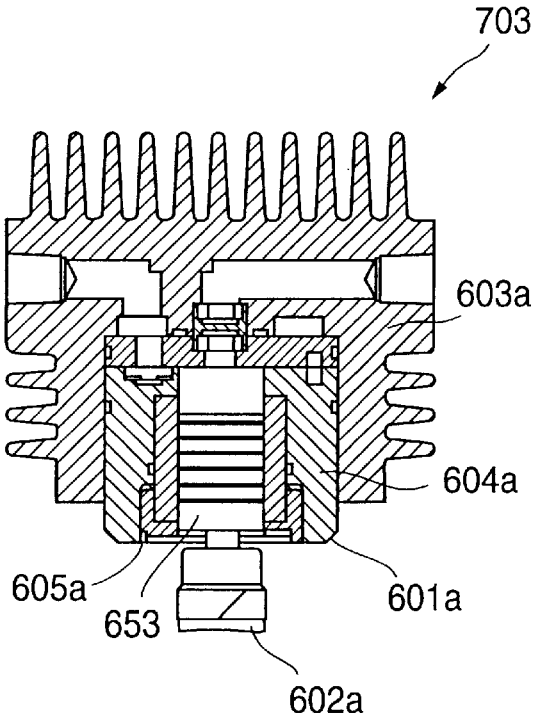
FIG. 36 is an explanatory view showing a section of the embodiment of a third reciprocating compression section of the multistage compression apparatus of the present invention shown in FIG. 34.

As shown in FIG. 36, the third reciprocating compression section (plunger pump) 703 of the multistage compression apparatus 700A of the present invention shown in FIG. 34 is constituted of the piston 653 inserted into a ceramic cylinder liner 601*a*, a connecting rod 602*a* connected to the piston 653 (connecting rod for connecting the piston 653 to the yoke 601A), and the like, and a sleeve 604*a* is interposed as the pressure resistant structure member between the cylinder liner 601*a* and a plunger pump main body 603*a*. Moreover, the cylinder liner 601*a* and sleeve 604*a* are fixed by screwing a fixing bolt 605*a* into the plunger pump main body 603*a*.

As shown in FIGS. 35, 36, since the sleeves 604, 604*a* are interposed as the pressure resistant structure members, and the cylinder liners 601, 601*a* and sleeves 604, 604*a* are fixed to the plunger pump main bodies 603, 603*a* by the fixing bolts 605, 605*a*, pressure resistant strengths of the ceramic cylinder lines 601, 601*a* can be enhanced. Additionally, according to the plunger pump constituted as described above, there can be provided a multistage compression apparatus which solves the problems that the vibration occurs, the cylinder liner 601, 601*a* moves and is damaged, the gap precision between the cylinder 601, 601*a* and the piston 654, 653 is deteriorated and the performance is deteriorated, and which enhances the durability and reliability.

Figure 37:
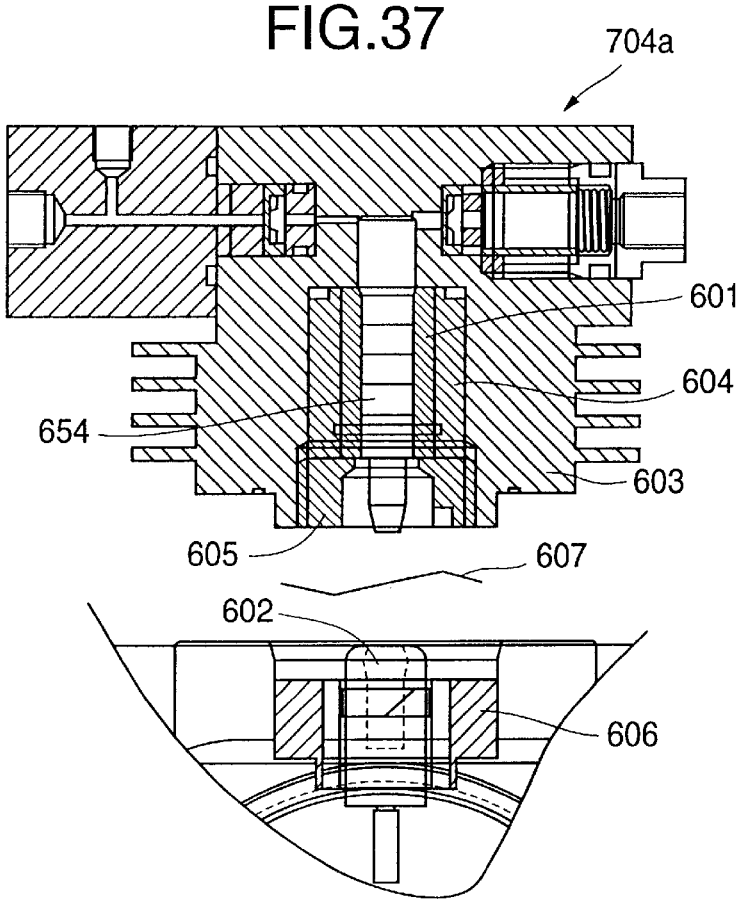
FIG. 37 is an explanatory view showing a section of another embodiment of the fourth reciprocating compression section of the multistage compression apparatus of the present invention shown in FIG. 34.

FIG. 37 is an explanatory view showing a section of still another embodiment of the fourth reciprocating compression section of the multistage compression apparatus of the present invention. As shown in FIG. 37, a fourth reciprocating compression section (plunger pump) 704*a* of this example is constituted similarly as the fourth reciprocating compression section 704 shown in FIG. 35, except that an elastic cushion member 607 such as a leaf spring is interposed and attached between a connecting rod sleeve 606 into which the connecting rod 602 is inserted and the fixing bolt 605. Since the elastic cushion member 607 such as the leaf spring is interposed and attached between the connecting rod sleeve 606 and the fixing bolt 605, the motion of the cylinder liner 601 or the sleeve 604 is further inhibited, the vibration is reduced, and the reliability is further enhanced.

Figure 38:
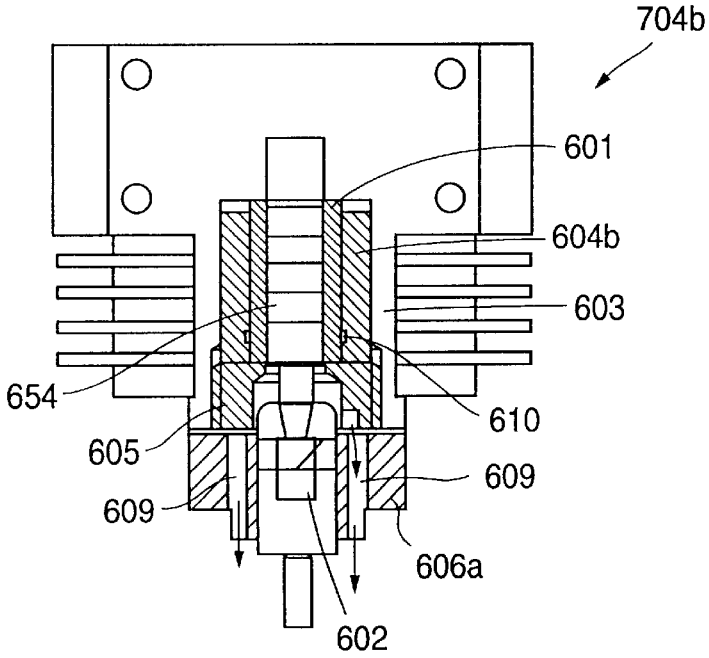
FIG. 38 is an explanatory view showing a section of another embodiment of the fourth reciprocating compression section of the multistage compression apparatus of the present invention shown in FIG. 34.

FIG. 38 is an explanatory view showing a section of still another embodiment of the fourth reciprocating compression section of the multistage compression apparatus of the present invention. As shown in FIG. 38, in a fourth reciprocating compression section (plunger pump) 704*b* of this example, one pressure release groove 608 (see FIG. 39) is disposed through a thickness direction of a sleeve 604*b* in a surface by which the sleeve 604*b* as the pressure resistant structure member is in contact with the fixing bolt 605. Moreover, a connecting rod sleeve 606*a* is provided with two pressure release holes 609 passed downward from above through the connecting rod sleeve 606*a*.

Figure 39A:
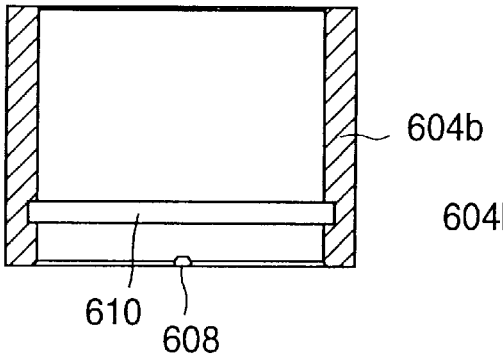
FIG. 39A is an explanatory view showing a longitudinal section of a sleeve as a pressure resistant structure member shown in FIG. 38.
Figure 39B:
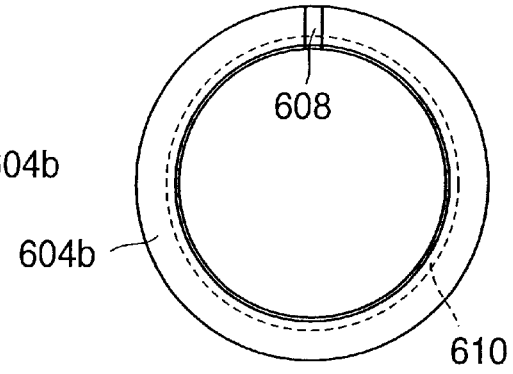
FIG. 39B is a bottom plan view of the sleeve as the pressure resistant structure member shown in FIG. 38.

FIG. 39A shows a longitudinal section of the sleeve 604*b*, and FIG. 39B shows the pressure release groove 608 disposed through the thickness direction of the sleeve 604*b* in the surface by which the sleeve 604*b* is in contact with the fixing bolt 605. Numeral 610 denotes an annular groove disposed in the inner wall surface of the sleeve 604*b*.

A gas between the sleeve 604*b* and the plunger pump main body 603 is passed through the pressure release groove 608, and subsequently passed through the pressure release holes 609 to escape into the multistage compression apparatus of the present invention as shown by arrows. Moreover, the gases between the cylinder liner 601 and the sleeve 604*b* and between the connecting rod 602 and the connecting rod sleeve 606*a* are similarly passed through the pressure release holes 609 to escape into the multistage compression apparatus of the present invention. This can prevent the pressure behind the cylinder from rising, and can also prevent the pressure between the connecting rod 602 and the connecting rod sleeve 606*a* from rising, the piston 654 smoothly moves, inputs are therefore reduced, biting of the piston 654 is prevented, and the reliability is enhanced.

Figure 41:
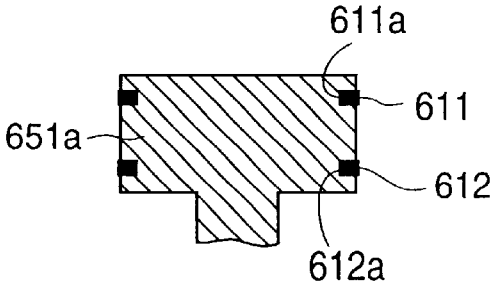
FIG. 41 is an explanatory view showing a section of the piston provided with a conventional piston ring and guide ring.

FIG. 41 is an explanatory view showing a section of the conventional piston (e.g., the piston 651 of FIG. 42) provided with the piston ring and guide ring. As shown in FIG. 41, a piston ring 611 and a guide ring 612 are just fitted in a piston ring groove 611*a* and a guide ring groove 612*a* formed in the piston 651.

Figure 40:
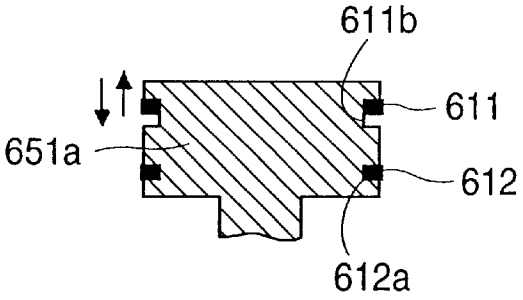
FIG. 40 is an explanatory view showing a section of the piston provided with a piston ring and guide ring for use in the present invention.

FIG. 40 is an explanatory view showing a section of a piston 651*a* provided with the piston ring and guide ring for use in the present invention. As shown in FIG. 40, the piston ring 611 is fitted in a piston ring groove 611*b* provided with a width larger than that of the piston ring 611. The guide ring 612 is just fitted in the guide ring groove 612*a*.

In this constitution, when the piston 651*a* reciprocates, the piston ring 611 also reciprocates in the piston ring groove 611*b* as shown by an arrow, a load on the piston ring 611 can be reduced, the PV value can be reduced as compared with the piston 651 shown in FIG. 41, and the mechanical loss can be reduced. The guide ring 612 and guide ring groove 612*a* can also be constituted similarly as the piston ring 611 and piston ring groove 611*b*.

Additionally, since the present invention is not limited to the aforementioned embodiment, various modifications are possible without departing from the scope defined by the appended claim.

For example, a plurality of reciprocating compression sections may be arranged in the L type, V type, W type, semi-star type, star type, opposite balance type, and the like as described above, or three or five or more reciprocating compression sections may be arranged in the star type in the multistage compression apparatus.

Therefore, by interposing the sleeve as the pressure resistant structure member between the cylinder liner and the plunger pump main body, and fixing the cylinder liner and sleeve to the plunger pump main body via the fixing bolt, the pressure resistant strength of the cylinder of the plunger pump is enhanced, and there can be provided the multistage compression apparatus which can solve the problems that the vibration occurs, the cylinder moves and is damaged, the gap precision between the cylinder and the piston is deteriorated and the performance is deteriorated, and which therefore enhances the durability and reliability.

By interposing and attaching the elastic cushion member such as the leaf spring between the connecting rod sleeve into which the connecting rod is inserted and the fixing bolt, the motion of the cylinder liner and sleeve is further inhibited, the vibration is reduced, and the reliability is further enhanced.

By disposing one or two or more pressure release grooves through the thickness direction in the surface by which the sleeve as the pressure resistant structure member contacts the fixing bolt, the pressure behind the cylinder can be prevented from rising, the input is reduced, the biting of the piston is prevented and the reliability is enhanced.

By disposing one or two or more pressure release holes through the connecting rod sleeve, the pressure between the connecting rod sleeve and the connecting rod can be prevented from rising and the piston smoothly moves, so that the input reduction is realized, the biting of the piston is prevented and the reliability is enhanced.

During attaching of the piston ring and guide ring, by setting either one or both of the piston ring groove and the guide ring groove disposed in the piston to be larger in width than the ring itself, the PV value of the piston ring or the guide ring can be reduced, and the mechanical loss can be reduced.

The multistage compression apparatus as still further embodiment will next be described. Here, the conventional multistage compression apparatus will be described with reference to FIG. 42. In the multistage compression apparatus 700, a pair of opposite pistons 651, 653 are connected to the yoke 601A, and a cross slider 602A disposed movably to cross the axis 706 in the yoke 601A is connected to the crank shaft 655 via the crank pin 656. Moreover, another pair of opposite pistons 652, 654 are connected to the yoke 601B disposed to deviate from the yoke 601A by 90 degrees, and a cross slider 602B disposed movably to cross the axis 705 in the yoke 601B is connected to the crank shaft 655 via the crank pin 656.

Moreover, when the crank shaft 655 is rotated by the electric motor (not shown) to rotate the crank pin 656 around the crank shaft 655, in the yoke 601A the cross slider 602A moves to handle the displacement of the crank pin 656 of the direction of the axis 705, and the yoke 601A moves to handle the displacement of the direction of the axis 706, and a pair of pistons 651, 653 therefore reciprocate only in the direction of the axis 706.

On the other hand, since in the yoke 601B the cross slider 602B moves to handle the displacement of the direction of the axis 706, and the yoke 601B moves to handle the displacement of the direction of the axis 705, a pair of pistons 652, 654 reciprocate only in the direction of the axis 705.

Moreover, in order to obtain the smooth reciprocating motion of the pistons 651, 652, 653, 654 from the constant-speed rotation of the crank shaft 655 through conversion, the cross slider 602A needs to easily slide in the yoke 601A, and the cross slider 602B needs to easily slide in the yoke 601B. For this purpose, the sliding portion is charged with grease and used.

However, in the multistage compression apparatus 700, since the sliding portion of the yoke 601A and cross slider 602A and the sliding portion of the yoke 601B and cross slider 602B are opened, the grease flies during operation, and there is a problem that the grease is insufficiently supplied to the sliding portion. When the grease supply to the sliding portion becomes insufficient in this manner, in long-period operation the vibration, wear, and the like cannot be inhibited, and the reliability is deteriorated.

On the other hand, in the multistage compression apparatus in which no piston is disposed in an opposite position, oscillation easily occurs with the shaft of the piston disposed opposite to the aforementioned position during operation, the occurrence of oscillation of the piston shaft results in averse influences such as biting and the reliability is disadvantageously deteriorated.

In this case, according to the present invention, there is provided a highly reliable multistage compression apparatus for compressing the required gas such as the nitrogen gas in multiple stages to the high pressure, in which the grease flying during operation is prevented, and the vibration, noise, wear, and the like are inhibited, and further there is provided a highly reliable multistage compression apparatus in which even when no piston is disposed in the opposite position, the oscillation of the piston shaft is inhibited from occurring during operation.

Figure 43:
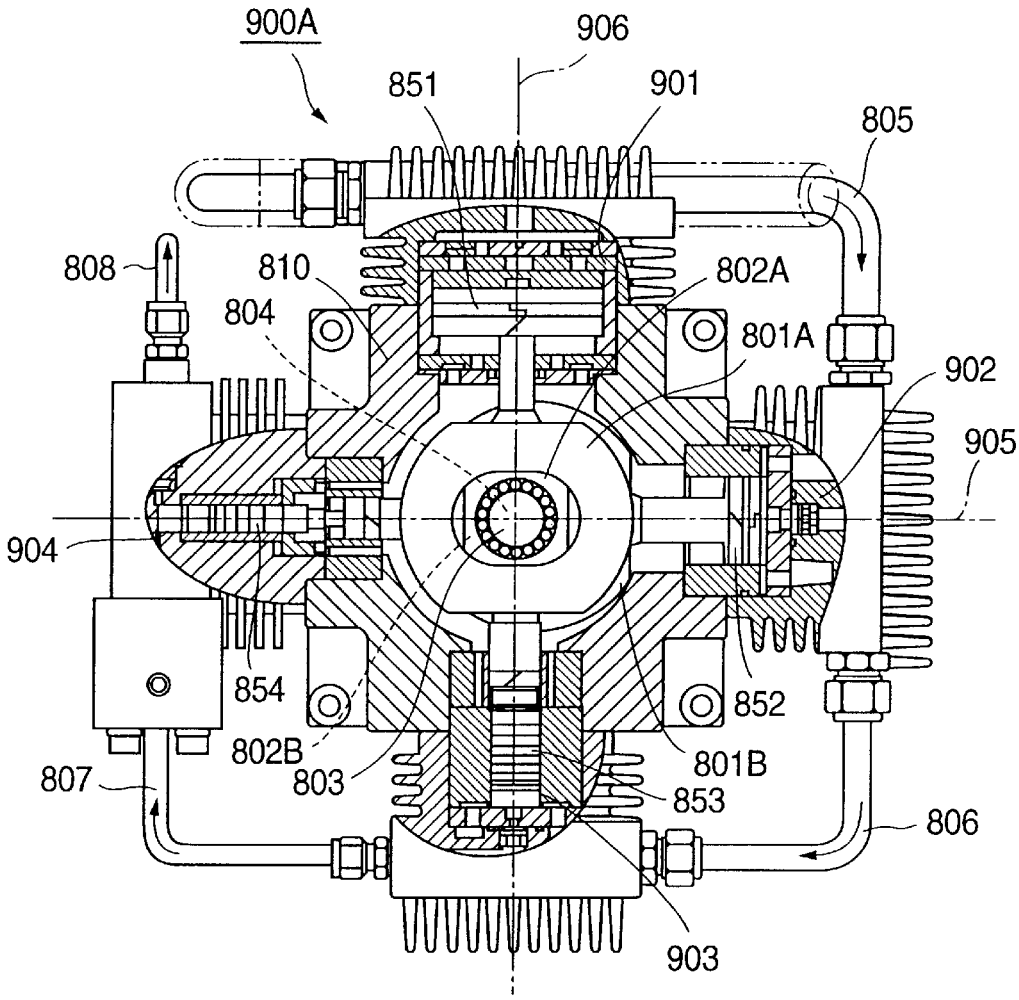
FIG. 43 is an explanatory view showing a section of another embodiment.

The embodiment of the present invention will be described hereinafter in detail with reference to FIGS. 43 to 47. FIG. 43 is an explanatory view showing a main part of the embodiment of the multistage compression apparatus of the present invention, FIG. 44 is an explanatory view showing the yoke, cross slider, and the like of the multistage compression apparatus of the present invention, FIG. 45 is an explanatory view showing a partial section of the yoke, cross slider, and the like of the multistage compression apparatus of the present invention shown in FIG. 43, FIG. 46 is a side view of the yoke shown in FIG. 45, and FIG. 47 is an explanatory view showing a main part of another multistage compression apparatus of the present invention.

In a multistage compression apparatus 900A of the present invention shown in FIG. 43, four reciprocating compression sections 901, 902, 903, 904 are arranged to reciprocate/cooperate on axes 905, 906 crossing at right angles to each other, the gas compressed in the respective reciprocating compression sections is transferred via pipelines 805 to 808 to successively raise the pressure in order from the reciprocating compression section 901 to the reciprocating compression section 904, and a cover 810 provided with an opening 809 in a middle portion is fixed and disposed to sandwich yokes 801A and 801B. The yoke 801A will be described hereinafter, but the yoke 801B is similar to the yoke 801A.

Figure 44:
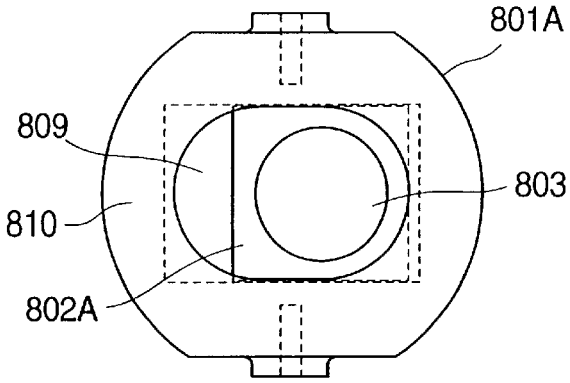
FIG. 44 is an explanatory view showing the yoke, cross slider, and the like of the multistage compression apparatus of the present invention shown in FIG. 43.
Figure 45:
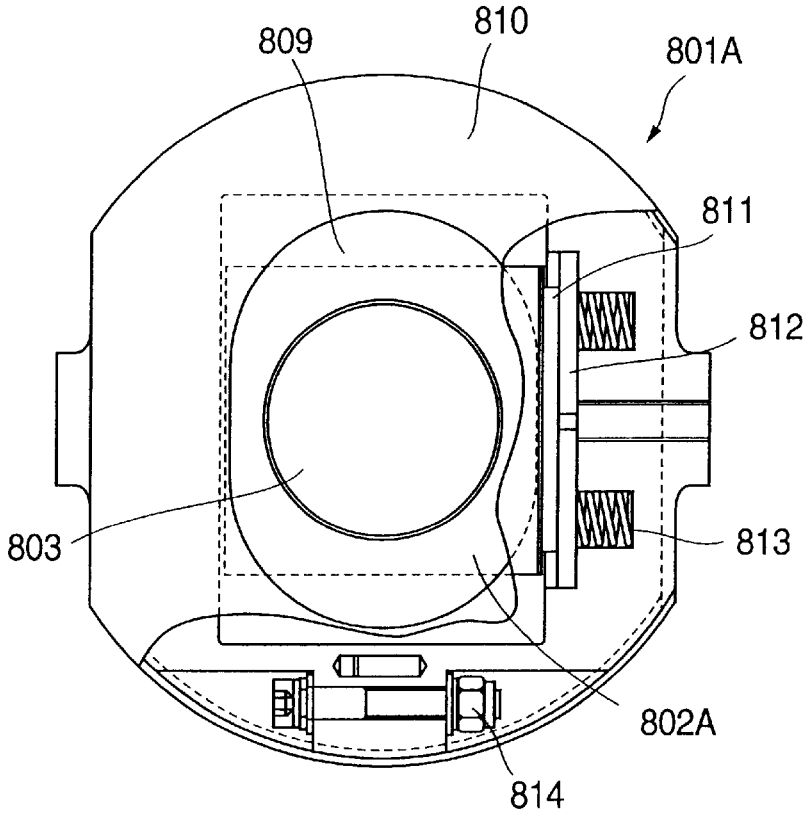
FIG. 45 is an explanatory view showing a partial section of the yoke, cross slider, and the like of the multistage compression apparatus of the present invention shown in FIG. 43.
Figure 46:
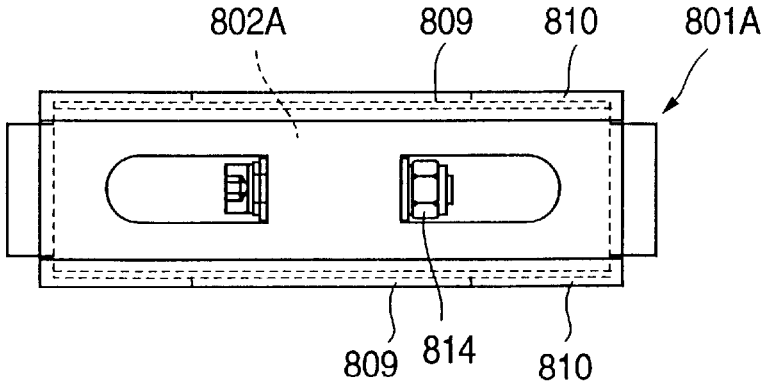
FIG. 46 is a side view of the yoke shown in FIG. 45.
Figure 47:
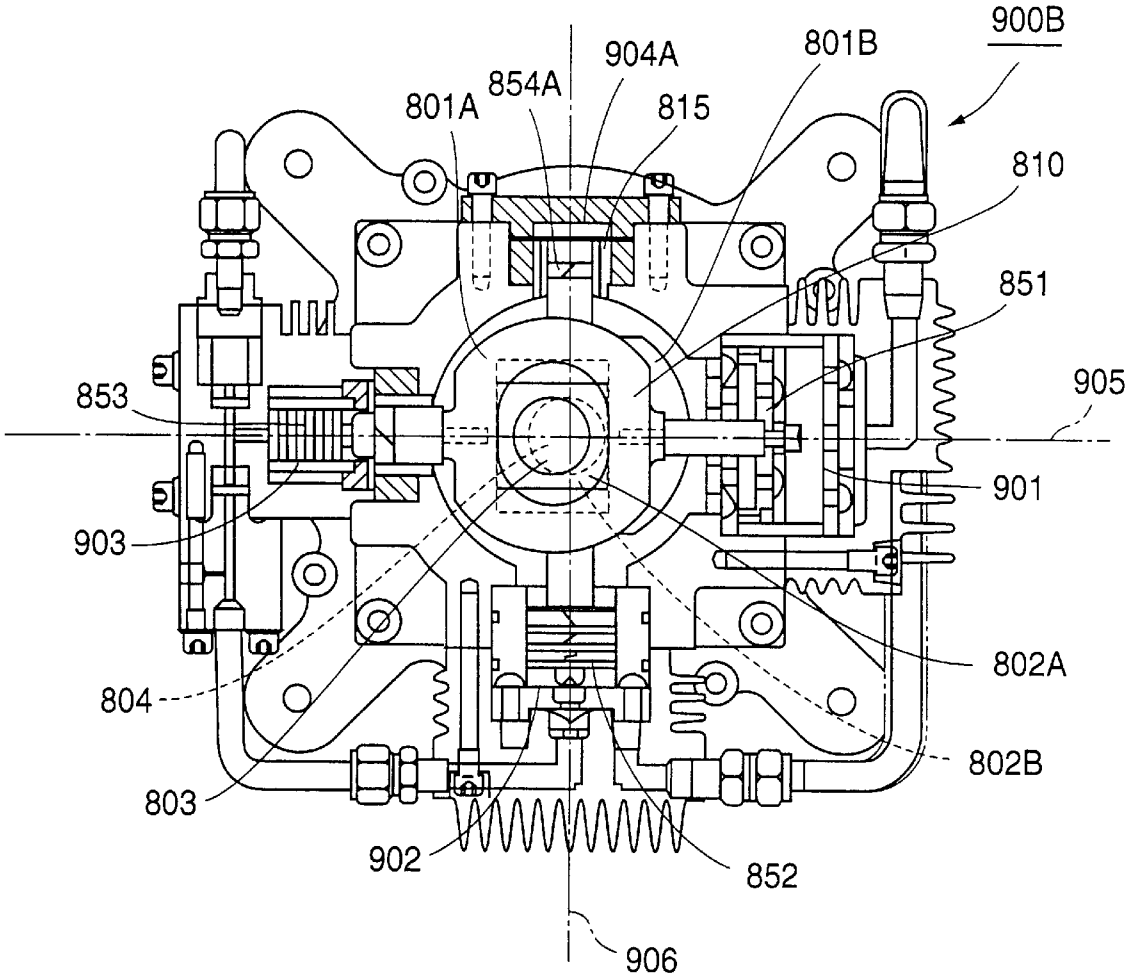
FIG. 47 is an explanatory view showing a main part of another multistage compression apparatus of the present invention.

As shown in FIGS. 44 to 46, the opening 809 of the cover 810 is disposed in the middle portion so that during apparatus operation an end of the opening 809 is prevented from contacting a crank pin 803 or hindering the motion of the crank pin 803. As shown in FIG. 46, the portion of the cover 810 other than the opening 809 is fixed and disposed to cover an opening in the yoke 801A and sandwich the yoke 801A.

A material of the cover 810 may be a metal, a nonmetal such as ceramic, FRP, and engineering plastic, or a combination of these, and is not particularly limited. Since engineering plastic is provided with physical and mechanical properties so that it can bear temperature and pressure during the apparatus operation, and is resistant to the compressed gas and grease, it can preferably be used.

In FIG. 45 numeral 811 denotes a roller bearing, 812 denotes a liner plate, 813 denotes a spring, and 814 denotes a fixing member. The roller bearing 811 is disposed to press opposite side surfaces of a cross slider 802A by an elastic force of the spring 813 exerted via the liner plate 812 and assists the sliding of the cross slider 802A in the yoke 801A.

In the multistage compression apparatus 900A of the present invention, since the cover 810 is fixed and disposed to sandwich the yokes 801A and 801B, the grease can be inhibited from flying from the yokes 801A and 801B during the apparatus operation. In the multistage compression apparatus 900A of the present invention since the grease is sufficiently supplied to the sliding portions in the yokes 801A and 801B, the vibration, noise, wear, and the like can be inhibited even in the long-period operation, and the reliability is enhanced.

When the cover 810 is shrink-fitted and fixed to the yokes 801A and 801B, the cover 810 is easily assembled, and additionally the cover 810 can firmly be disposed and prevented from dropping, so that the reliability is further enhanced.

A multistage compression apparatus 900B (three-stage compression apparatus) of the present invention shown in FIG. 47 is provided with no piston in a position 904A opposite to a piston 852 of the reciprocating compression section 902. Pistons 851, 853 of the three reciprocating compression sections 901, 902, 903 reciprocate only in the direction of the axis 905, the piston 852 and a connecting rod 854A are arranged to reciprocate/cooperate on the axis 906, and the pressure is successively raised from the reciprocating compression section 901 to the reciprocating compression section 903 to set the reciprocating compression section 903 as the high-pressure compression section of the final stage in the multistage compression apparatus. The connecting rod 854A is fixed to the yoke 801B in the position 904A opposite to the piston 852, and the connecting rod 854A is disposed in a cylinder 815 for guiding the rod so that the rod can reciprocate.

As described above, in the multistage compression apparatus 900B, a pair of opposite pistons 851, 853 are connected to the yoke 801A, and another pair of piston 852 and connecting rod 854A are connected to the yoke 801B disposed to deviate from the yoke 801A by 90 degrees, a crank shaft 804 is rotated by the electric motor (not shown) to rotate a crank pin 803 around the crank shaft 804, the pair of pistons 851, 853 are reciprocated only in the direction of the axis 905, and the other pair of piston 852 and connecting rod 854A are reciprocated only in the direction of the axis 906.

For the multistage compression apparatus 900B of the present invention, similarly as the multistage compression apparatus 900A of the present invention, since the cover 810 is fixed and disposed to sandwich the yokes 801A and 801B, the grease flying during the apparatus operation can be inhibited and the grease supply to the sliding portion becomes sufficient. Therefore, even in the long-period operation the vibration, noise, wear, and the like can be inhibited, and the reliability is enhanced. Moreover, since the connecting rod 854A is fixed to the yoke 801B, and the cylinder 815 for guiding the connecting rod 854A so that the rod can reciprocate is disposed, during the operation the oscillation of the shaft of the piston 852 opposite to the connecting rod 854A can be prevented from occurring, no biting occurs, the operation can steadily be performed and the reliability is further enhanced.

Additionally, since the present invention is not limited to the aforementioned embodiment, various modifications are possible without departing from the scope defined in the appended claims.

For example, a plurality of reciprocating compression sections may be arranged in the L type, V type, W type, semi-star type, star type, opposite balance type, and the like as described above, or three or five or more reciprocating compression sections may be arranged in the star type in the multistage compression apparatus.

By the aforementioned constitution, in the multistage compression apparatus of the present invention in which the cover provided with the opening in the middle portion not to hinder the crank pin motion is fixed and disposed to sandwich the yoke, during the operation the grease can be inhibited from flying from the yoke, the supply of the grease to the cross slider sliding portion becomes sufficient, the vibration, noise, wear, and the like can be inhibited even in the long-period operation, and the reliability is high.

It is preferable to shrink-fit and fix the cover to the yoke, in this case the cover is easily assembled, and additionally the cover can firmly be fixed to the yoke and prevented from dropping, so that the reliability is further enhanced.

Even when at least one pair is provided with no piston in the opposite position, by disposing the connecting rod fixed to the yoke, and the cylinder for guiding the connecting rod so that the connecting rod can reciprocate in the position, the oscillation of the shaft of the piston opposite to the connecting rod can be prevented from occurring, and the reliability is enhanced.

Figure 51:
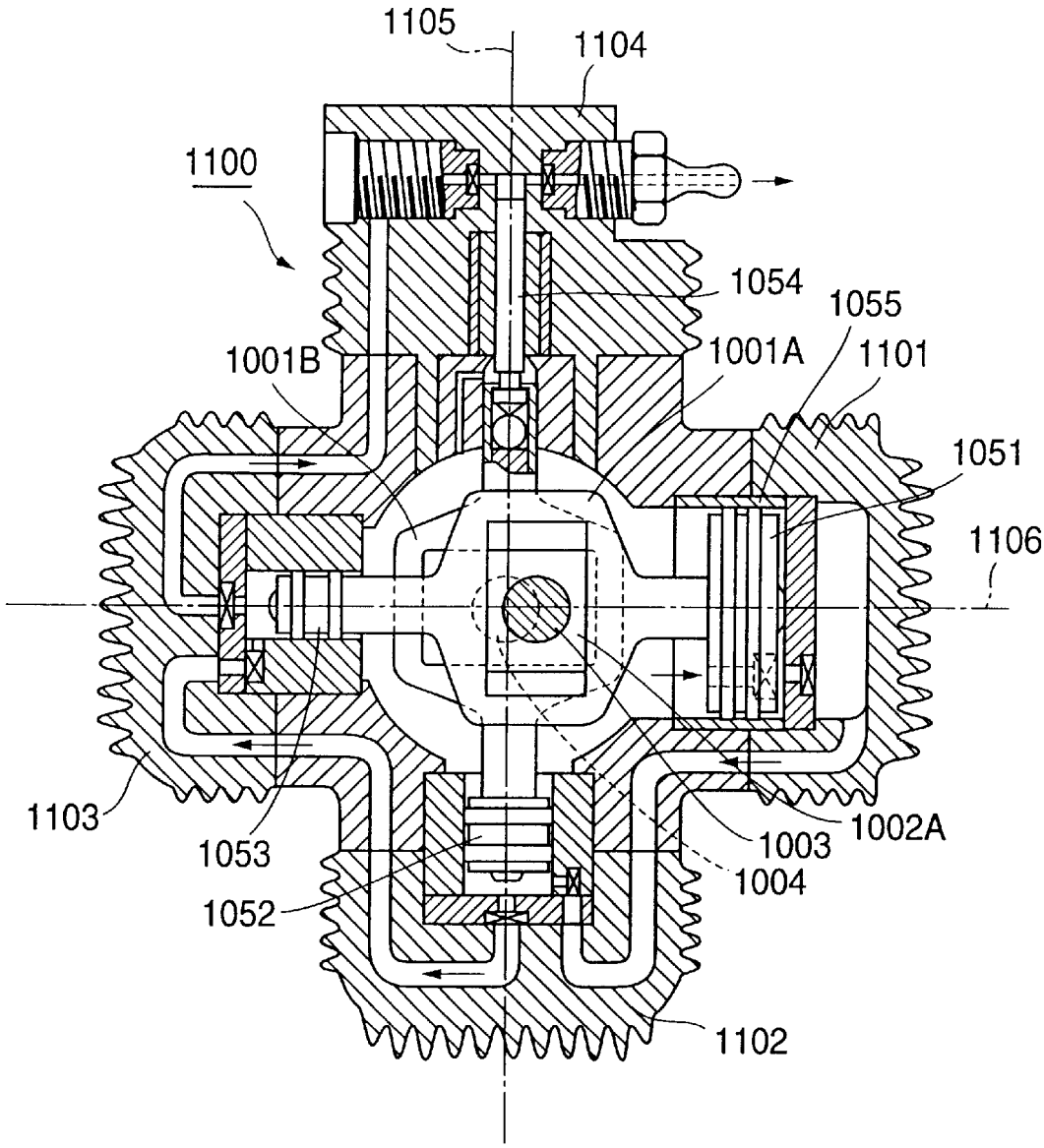
FIG. 51 is an explanatory view showing the section of the conventional multistage compression apparatus.

The multistage compression apparatus as still another embodiment will next be described. As the conventional multistage compression apparatus, as shown in FIG. 51, a multistage compression apparatus 1100 is known in which four reciprocating compression sections 1101, 1102, 1103, 1104 are arranged to reciprocate/cooperate on axes 1105, 1106 crossing at right angles to each other, the pressure is successively raised from the reciprocating compression section 1101 and the reciprocating compression section 1104 is set as the high-pressure compression section of the final stage.

Moreover, in the multistage compression apparatus 1100, a pair of opposite pistons 1051, 1053 are connected to a yoke 1001A, and a cross slider 1002A disposed movably to cross the axis 1106 in the yoke 1001A is connected to a crank shaft 1004 via a crank pin 1003. Moreover, another pair of opposite pistons 1052, 1054 are connected to a yoke 1001B disposed to deviate from the yoke 1001A by 90 degrees, and a cross slider (not shown) disposed movably to cross the axis 1105 in the yoke 1001B is also connected to the crank shaft 1004 via the crank pin 1003.

Furthermore, when the crank shaft 1004 is rotated by the electric motor (not shown) to rotate the crank pin 1003 around the crank shaft 1004, in the yoke 1001A the cross slider 1002A moves to handle the displacement of the crank pin 1003 of the direction of the axis 1105, the yoke 1001A moves to handle the displacement of the direction of the axis 1106, and the pair of pistons 1051, 1053 therefore reciprocate only in the direction of the axis 1106.

On the other hand, in the yoke 1001B the cross slider (not shown) moves to handle the displacement of the direction of the axis 1106, the yoke 1001B moves to handle the displacement of the direction of the axis 1105, and the pair of pistons 1052, 1054 reciprocate only in the direction of the axis 1105.

Figure 50:
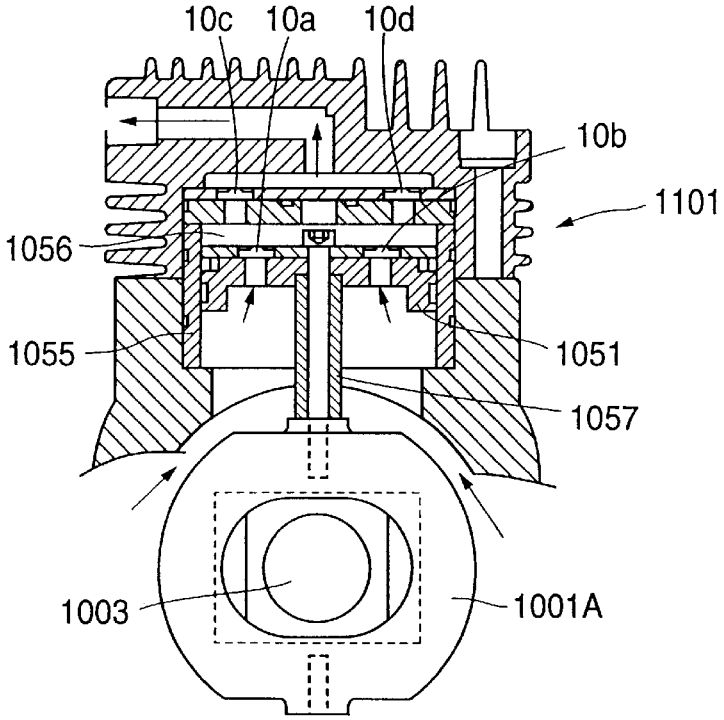
FIG. 50 is an explanatory view showing a sectional structure of the first reciprocating compression section of a conventional multistage compression apparatus.

FIG. 50 is an explanatory view showing a sectional structure of the first reciprocating compression section 1101 of the multistage compression apparatus 1100. The piston 1051 of the first reciprocating compression section 1101 moves backward, valves 10*c*, 10*d* close, valves 10*a*, 10*b* open and a gas is sucked into a compression chamber 1056 in a cylinder 1055 via the valves 10*a*, 10*b* from directions shown by arrows, then the piston 1051 advances to close the valves 10*a*, 10*b*, the gas is compressed in the compression chamber 1056 and reaches the predetermined pressure to open the valves 10*c*, 10*d*, the gas is discharged from the compression chamber 1056 via the valves 10*c*, 10*d* in directions shown by arrows, and the gas is fed to the second reciprocating compression section 1102 (not shown). Numeral 1057 is a connecting rod for connecting the piston 1051 to the yoke 1001A.

In the multistage compression apparatus 1100, for example, it is requested that the discharge amount can efficiently be increased without increasing the diameter of the cylinder 1055 of the first reciprocating compression section 1101.

Then, according to the present invention, in the multistage compression apparatus for compressing required gases such as a nitrogen gas in multiple stages to the high pressure, for example, the discharge amount can efficiently be increased without enlarging the diameter of the cylinder of the first reciprocating compression section.

Figure 48:
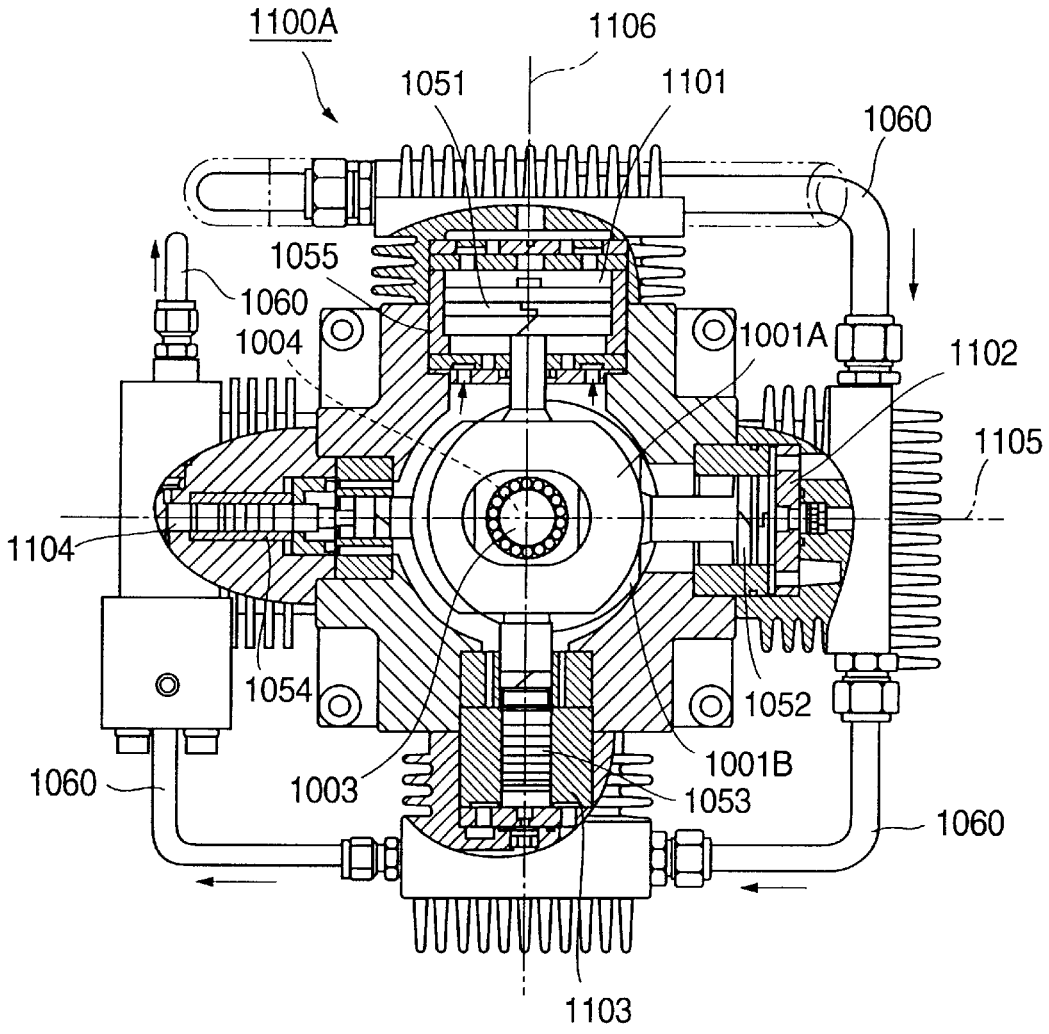
FIG. 48 is an explanatory view showing a main part of the multistage compression apparatus according to further embodiment of the present invention.

The embodiment of the present invention will be described hereinafter in detail with reference to FIGS. 48 and 49. FIG. 48 is an explanatory view showing a main part of the embodiment of the multistage compression apparatus of the present invention, and FIG. 49 is an explanatory view showing a sectional structure of the first reciprocating compression section of the multistage compression apparatus of the present invention shown in FIG. 48.

Additionally, in these drawings the components denoted by the same reference numerals as those of FIGS. 50, 51 have functions similar to those described in the related art, and the description thereof is omitted as long as the understanding of the present invention is not hindered.

As shown in FIG. 48, a multistage compression apparatus 1100A of the present invention is similar to the multistage compression apparatus 1100 shown in FIG. 51, except that the gas compressed in the first reciprocating compression section 1101 provided with a double compression structure is fed to the next reciprocating compression section via a pipeline 1060 and is successively highly pressurized. Specifically, the four reciprocating compression sections 1101, 1102, 1103, 1104 are arranged to reciprocate/cooperate on the axes 1105, 1106 crossing at right angles to each other, the gas is successively highly pressurized from the first reciprocating compression section 1101 and fed to the next reciprocating compression section via the pipeline 1060 and the fourth reciprocating compression section 1104 is set as the high-pressure compression section of the final stage.

Figure 49:
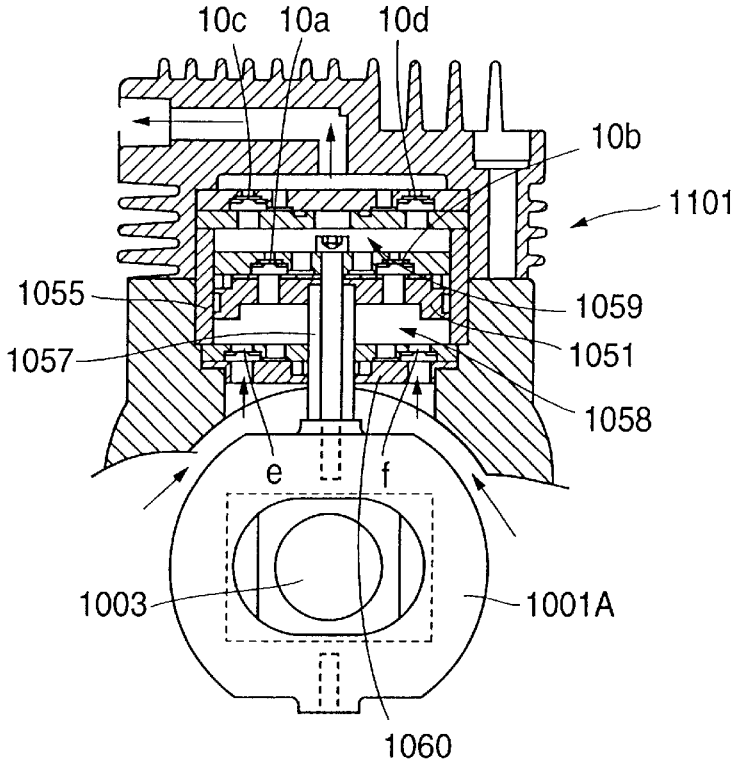
FIG. 49 is an explanatory view showing a sectional structure of a first reciprocating compression section of the multistage compression apparatus of the present invention shown in FIG. 48.

FIG. 49 is an explanatory view showing a sectional structure of the first reciprocating compression section 1101 of the multistage compression apparatus 1100A of the present invention. The first reciprocating compression section 1101 is provided with a first compression chamber 1058 and a second compression chamber 1059. When the piston 1051 advances to close the vales 10*a*, 10*b*, the gas is sucked into the first compression chamber 1058 via opened valves 10*e*, 10*f* from the directions shown by arrows and the gas in the second compression chamber 1059 is compressed to reach the predetermined pressure, and the gas is then discharged to the outside via the opened valves 10*c*, 10*d* and fed to the next reciprocating compression section as shown by arrows. Subsequently, when the piston 1051 moves backward to close the valves 10*e*, 10*f*, and the gas in the first compression chamber 1058 is compressed to reach the predetermined pressure and open the valves 10*a*, 10*b* and is discharged to the second compression chamber 1059. Additionally, numeral 1060 denotes a rod guide for smoothly guiding the connecting rod 1057 to a determined position so that no vibration occurs.

In the present invention, a structure in which the gas is sucked, compressed and discharged in one cylinder 1055 in two stages in this manner is referred to as the double compression structure.

The nitrogen gas, the cylinders of the same size, and an actual apparatus were used to measure discharge amounts ($m^3$/hr) in the first reciprocating compression section provided with the normal compression structure shown in FIG. 50 and in the first reciprocating compression section provided with the double compression structure shown in FIG. 49.

As the test result, a discharge amount of 4.3 $m^3$/hr was obtained in the compression section provided with the normal compression structure, and a discharge amount of 4.8 $m^3$/hr was obtained in the compression section provided with the double compression structure. It has been found from the test result that when the compression section provided with the double compression structure is used, the discharge amount is 4.8/4.3=1.116 and can be increased by about 11.6%. A theoretical value is 12%, and substantially the same value as the theoretical value was obtained in the test.

Additionally, since the present invention is not limited to the aforementioned embodiment, various modifications are possible without departing from the scope defined in the appended claims.

For example, in the aforementioned embodiment, the first reciprocating compression section is provided with the double compression structure, but the second reciprocating compression section may also be provided with the double compression structure in the multistage compression apparatus.

Moreover, a plurality of reciprocating compression sections may be arranged in the L type, V type, W type, semi-star type, star type, opposite balance type, and the like as described above, or three or five or more reciprocating compression sections may be arranged in the star type in the multistage compression apparatus.

In the multistage compression apparatus of the present invention, for example, by providing the first reciprocating compression section with the double compression structure, the discharge amount can efficiently be increased without enlarging the diameter of the cylinder.

What is claimed is:

1. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a labyrinth seal structure in which a plurality of labyrinth grooves are formed in a peripheral surface of said piston and no lubrication is performed between the peripheral surface of said piston and an operation inner surface of said cylinder, and a tip end peripheral edge of said piston and an opening end of said labyrinth groove are R-chamfered.

2. A high pressure compressor as set forth in claim 1 further comprising a compression apparatus, provided with at least one pair of opposite pistons, a yoke to which the pistons are fixed, and a cross slider and moving in the yoke, for obtaining a reciprocating motion of the piston from a rotation motion of a crank shaft through conversion by a scotch yoke mechanism, wherein a cover provided with an opening disposed in a middle portion not to inhibit a crank pin motion is fixed and disposed to sandwich the yoke.

3. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a labyrinth seal structure in which a plurality of labyrinth grooves are formed in a peripheral surface of said piston and no lubrication is performed between the peripheral surface of said piston and an operation inner surface of said cylinder, and for a relation between said piston and said cylinder, in a top dead point and a lower dead point in the reciprocating/driving of said piston, a tip end peripheral edge and a rear end peripheral edge of said piston are positioned not to enter the operation inner surface of said cylinder.

4. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, a tip end small diameter portion is formed on said piston, and a small diameter compression section into which the tip end small diameter portion of said piston is inserted when said piston is in a top dead point, and a large diameter portion for forming a compression space in the periphery of the tip end small diameter portion of said piston when said piston is in a lower dead point are continuously formed on said cylinder.

5. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, and a protrusion shape of a tip end of said piston and a shape of an inner surface of a cylinder head opposite to the tip end are formed in the same R shape.

6. The compression apparatus according to any one of claims 1 or 3–5 provided with a plurality of stages of compression sections each comprising the cylinder and the piston, for successively passing the gas through the respective compression sections to compress and supply the gas, wherein the compression section of the final stage and the compression section of the stage before the final stage comprise plunger pistons.

7. The compression apparatus according to any one of claims 1 or 3–5 wherein a gap of a diametric direction between the cylinder of the compression section of the final stage and the piston reciprocating/operating inside the cylinder is smaller than a gap between the cylinder of the stage before the final stage and the piston reciprocating/operating in the cylinder.

8. The compression apparatus according to claims 1 or 3 to 5 wherein the gap of the diametric direction between the cylinder of the compression section of the stage before the final stage and the piston reciprocating/operating in the cylinder is in a range of 3 to 10 $\mu$m.

9. The compression apparatus according to any one of claims 1 or 3–5 wherein said piston has a diameter in the range of from about 22 mm to about 78 mm and the gap of the diametric direction between the cylinder of the compression section of the final stage and the piston reciprocating/operating in the cylinder is in a range of 2 to 8 $\mu$m.

10. The compression apparatus according to any one of claims 1 or 3 to 5 wherein said compression section is constituted of four stages.

11. The compression apparatus according to any one of claims 1 or 3 to 5 wherein a width of either one or both of a piston ring groove and a guide ring groove, disposed in the piston, for attaching a piston ring and a guide ring, is larger than the width of the ring itself.

12. A compression apparatus, provided with a plurality of stages of compression sections each comprising a cylinder and a piston, for successively passing a gas through the respective compression sections to compress and supply the gas, wherein the compression section of the final stage and the compression section of the stage before the final stage comprise plunger pistons.

13. The compression apparatus according to claim 12 wherein a gap of a diametric direction between the cylinder of the compression section of the final stage and the piston reciprocating/operating inside the cylinder is smaller than a gap between the cylinder of the stage before the final stage and the piston reciprocating/operating in the cylinder.

14. The compression apparatus according to claim 12 or 7 wherein the gap of the diametric direction between the cylinder of the compression section of the stage before the final stage and the piston reciprocating/operating in the cylinder is in a range of 3 to 10 $\mu$m.

15. The compression apparatus according to claim 14 wherein said piston has a diameter in the range of from about 22 mm to about 78 mm and the gap of the diameter direction between the cylinder of the compression section of the final stage and the piston reciprocating/operating in the cylinder is in a range of 2 to 8 $\mu$m.

16. A compression apparatus provided with a plurality of stages of compression sections each comprising a cylinder and a piston, for successively passing a gas through the respective compression sections to compress and supply the gas, wherein the compression section of the final stage and the compression section of the stage before the final stage comprise plunger pistons;

a gap of a diametric direction between the cylinder of the compression section of the final stage and the piston reciprocating/operating inside the cylinder that is smaller than a gap between the cylinder of the stage before the final stage and the piston reciprocating/operating in the cylinder;

wherein the gap of the diametric direction between the cylinder of the compression section of the stage before the final stage and the piston reciprocating/operating in the cylinder is in a range of 3 to 10 $\mu$m;

wherein the gap of the diametric direction between the cylinder of the compression section of the final stage and the piston reciprocating/operating in the cylinder is in a range of 2 to 8 $\mu$m; and wherein the piston reciprocating/operating in the cylinder of the compression section of the stage before the final stage comprises a plurality of grooves on a surface, and a ratio (B/A) of a groove depth B to a groove width A is in a range of 0.2 to 0.5.

17. The compression apparatus according to claim 16 wherein said compression section is constituted of four stages.

18. A compression apparatus, provided with a plurality of compression sections, at least one of the compression sections comprising a plunger piston type compressor, said plurality of compression sections being connected in series by a connection pipe, for successively performing a compression process of feeding an operating fluid compressed by said compression section of a previous stage to said compression section of a subsequent stage, and compressing the operating fluid in the compression section of the subsequent stage to generate the high-pressure operating fluid, wherein a plunger piston in said plunger piston type compressor is sealed by a labyrinth seal constituted by a plurality of labyrinth grooves, and the labyrinth grooves are formed so that a forming density of the labyrinth grooves decreases to the side of a back pressure chamber from the side of a compression chamber.

19. A compression apparatus, provided with a plurality of reciprocating compression sections, for compressing a gas in multiple stages, wherein at least the reciprocating compression section of a first stage is provided with a first compression chamber and a second compression chamber, and a double compression structure of discharging the gas sucked and compressed in the first compression chamber to the second compression chamber and again compressing the gas and subsequently discharging and feeding the gas to the reciprocating compression section of the next stage is disposed.

20. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a labyrinth seal structure in which a plurality of labyrinth grooves are formed in a peripheral surface of said piston and no lubrication is performed between the peripheral surface of said piston and an operation inner surface of said cylinder, and a tip end peripheral edge of said piston and an opening end of said labyrinth groove are R-chamfered; and wherein the piston reciprocating/operating in the cylinder of the compression section of the stage before the final stage comprises a plurality of grooves on a surface, and a ratio (B/A) of a groove depth B to a groove width A is in a range of 0.2 to 0.5.

21. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a labyrinth seal structure in which a plurality of labyrinth grooves are formed in a peripheral surface of said piston and no lubrication is performed between the peripheral surface of said piston and an operation inner surface of said cylinder, and a tip end peripheral edge of said piston and an opening end of said labyrinth groove are R-chamfered; and a plurality of compression sections, at least one of the compression sections comprising a plunger piston type compressor, said plurality of compression sections being connected in series by a connection pipe, for successively performing a compression process of feeding the operating fluid compressed by said compression section of a previous stage to said compression section of a subsequent stage, and compressing the operating fluid in the compression section of the subsequent stage to generate the high-pressure operating fluid, wherein a plunger piston in said plunger piston type compressor is sealed by a labyrinth seal constituted by the plurality of labyrinth grooves, and the labyrinth grooves are formed so that a forming density of the labyrinth grooves decreases to the side of a back pressure chamber from the side of a compression chamber.

22. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a labyrinth seal structure in which a plurality of labyrinth grooves are formed in a peripheral surface of said piston and no lubrication is performed between the peripheral surface of said piston and an operation inner surface of said cylinder, and a tip end peripheral edge of said piston and an opening end of said labyrinth groove are R-chamfered, and compression means provided with a plurality of compression sections, driving means for driving the compression means, and a sealed case in which the driving means is disposed and whose top portion closely abuts on said compression means, wherein a relief valve, opened when a pressure in said sealed case is equal to or more than a predetermined pressure, is disposed in a bottom of the sealed case.

23. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a labyrinth seal structure in which a plurality of labyrinth grooves are formed in a peripheral surface of said piston and no lubrication is performed between the peripheral surface of said piston and an operation inner surface of said cylinder, and a tip end peripheral edge of said piston and an opening end of said labyrinth groove are R-chamfered; and wherein one or two or more pressure release grooves are disposed through a thickness direction in a surface of a sleeve by which the sleeve as the pressure resistant structure member contacts a fixing bolt.

24. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a labyrinth seal structure in which a plurality of labyrinth grooves are formed in a peripheral surface of said piston and no lubrication is performed between the peripheral surface of said piston and an operation inner surface of said cylinder, and a tip end peripheral edge of said piston and an opening end of said labyrinth groove are R-chamfered and a plurality of reciprocating compression sections, for compressing the gas in multiple stages, wherein at least the reciprocating compression section of a first stage is provided with a first compression chamber and a second compression chamber, and a double compression structure of discharging the gas sucked and compressed in the first compression chamber to the second compression chamber and again compressing the gas and subsequently discharging and feeding the gas to the reciprocating compression section of the next stage is disposed.

25. A high pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a labyrinth seal structure in which a plurality of labyrinth grooves are formed in a peripheral surface of said piston and no lubrication is performed between the peripheral surface of said piston and an operation inner surface of said cylinder, and a tip end peripheral edge of said piston and an opening end of said labyrinth groove are R-chamfered and compression means provided with a plurality of compression sections, driving means for driving the compression means, and a sealed case in which the driving means is disposed and whose top portion closely abuts on said compression means, wherein a relief valve, opened when a pressure in said sealed case is equal to or more than a predetermined pressure, is disposed in a bottom of the sealed case.

26. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a labyrinth seal structure in which a plurality of labyrinth grooves are formed in a peripheral surface of said piston and no lubrication is performed between the peripheral surface of said piston and an operation inner surface of said cylinder, and for a relation between said piston and said cylinder, in a top dead point and a lower dead point in the reciprocating/driving of said piston, a tip end peripheral edge and a rear end peripheral edge of said piston are positioned not to enter the operation inner surface of said cylinder; and wherein the piston reciprocating/operating in the cylinder of the compression section of the stage before the final stage comprises a plurality of grooves on a surface, and a ratio (B/A) of a groove depth B to a groove width A is in a range of 0.2 to 0.5.

27. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, a tip end small diameter portion is formed on said piston, and a small diameter compression section into which the tip end small diameter portion of said piston is inserted when said piston is in a top dead point, and a large diameter portion for forming a compression space in the periphery of the tip end small diameter portion of said piston when said piston is in a lower dead point are continuously formed on said cylinder; and wherein the piston reciprocating/operating in the cylinder of the compression section of the stage before the final stage comprises a plurality of grooves on a surface, and a ratio (B/A) of a groove depth B to a groove width A is in a range of 0.2 to 0.5.

28. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, and said piston is connected to a connecting rod by pressing a connecting flange portion extended to a rear end of said piston in a connection space formed in said connecting rod by a spring so that said piston can oscillate with respect to said connecting rod; and wherein the piston reciprocating/operating in the cylinder of the compression section of the stage before the final stage comprises a plurality of grooves on a surface, and a ratio (B/A) of a groove depth B to a groove width A is in a range of 0.2 to 0.5.

29. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of -said cylinder and said piston, and a protrusion shape of a tip end of said piston and a shape of an inner surface of a cylinder head opposite to the tip end are formed in the same R shape; and wherein the piston reciprocating/operating in the cylinder of the compression section of the stage before the final stage comprises a plurality of grooves on a surface, and a ratio (B/A) of a groove depth B to a groove width A is in a range of 0.2 to 0.5.

30. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a labyrinth seal structure in which a plurality of labyrinth grooves are formed in a peripheral surface of said piston and no lubrication is performed between the peripheral surface of said piston and an operation inner surface of said cylinder, and for a relation between said piston and said cylinder, in a top dead point and a lower dead point in the reciprocating/driving of said piston, a tip end peripheral edge and a rear end peripheral edge of said piston are positioned not to enter the operation inner surface of said cylinder; and a plurality of compression sections, at least one of the compression sections comprising a plunger piston type compressor, said plurality of compression sections being connected in series by a connection pipe, for successively performing a compression process of feeding the operating fluid compressed by said compression section of a previous stage to said compression section of a subsequent stage, and compressing the operating fluid in the compression section of the subsequent stage to generate the high-pressure operating fluid, wherein a plunger piston in said plunger piston type compressor is sealed by a labyrinth seal constituted by the plurality of labyrinth grooves, and the labyrinth grooves are formed so that a forming density of the labyrinth grooves decreases to the side of a back pressure chamber from the side of a compression chamber.

31. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, a tip end small diameter portion is formed on said piston, and a small diameter compression section into which the tip end small diameter portion of said piston is inserted when said piston is in a top dead point, and a large diameter portion for forming a compression space in the periphery of the tip end small diameter portion of said piston when said piston is in a lower dead point are continuously formed on said cylinder; and a plurality of compression sections, at least one of the compression sections comprising a plunger piston type compressor, said plurality of compression sections being connected in series by a connection pipe, for successively performing a compression process of feeding the operating fluid compressed by said compression section of a previous stage to said compression section of a subsequent stage, and compressing the operating fluid in the compression section of the subsequent stage to generate the high-pressure operating fluid, wherein a plunger piston in said plunger piston type compressor is sealed by a labyrinth seal constituted by the plurality of labyrinth grooves, and the labyrinth grooves are formed so that a forming density of the labyrinth grooves decreases to the side of a back pressure chamber from the side of a compression chamber.

32. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, and said piston is connected to a connecting rod by pressing a connecting flange portion extended to a rear end of said piston in a connection space formed in said connecting rod by a spring so that said piston can oscillate with respect to said connecting rod; and a plurality of compression sections, at least one of the compression sections comprising a plunger piston type compressor, said plurality of compression sections being connected in series by a connection pipe, for successively performing a compression process of feeding the operating fluid compressed by said compression section of a previous stage to said compression section of a subsequent stage, and compressing the operating fluid in the compression section of the subsequent stage to generate the high-pressure operating fluid, wherein a plunger piston in said plunger piston type compressor is sealed by a labyrinth seal constituted by the plurality of labyrinth grooves, and the labyrinth grooves are formed so that a forming density of the labyrinth grooves decreases to the side of a back pressure chamber from the side of a compression chamber.

33. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, and a protrusion shape of a tip end of said piston and a shape of an inner surface of a cylinder head opposite to the tip end are formed in the same R shape; and a plurality of compression sections, at least one of the compression sections comprising a plunger piston type compressor, said plurality of compression sections being connected in series by a connection pipe, for successively performing a compression process of feeding the operating fluid compressed by said compression section of a previous stage to said compression section of a subsequent stage, and compressing the operating fluid in the compression section of the subsequent stage to generate the high-pressure operating fluid, wherein a plunger piston in said plunger piston type compressor is sealed by a labyrinth seal constituted by the plurality of labyrinth grooves, and the labyrinth grooves are formed so that a forming density of the labyrinth grooves decreases to the side of a back pressure chamber from the side of a compression chamber.

34. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a labyrinth seal structure in which a plurality of labyrinth grooves are formed in a peripheral surface of said piston and no lubrication is performed between the peripheral surface of said piston and an operation inner surface of said cylinder, and for a relation between said piston and said cylinder, in a top dead point and a lower dead point in the reciprocating/driving of said piston, a tip end peripheral edge and a rear end peripheral edge of said piston are positioned not to enter the operation inner surface of said cylinder; and wherein one or two or more pressure release grooves are disposed through a thickness direction in a surface of a sleeve by which the sleeve as the pressure resistant structure member contacts a fixing bolt.

35. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, a tip end small diameter portion is formed on said piston, and a small diameter compression section into which the tip end small diameter portion of said piston is inserted when said piston is in a top dead point, and a large diameter portion for forming a compression space in the periphery of the tip end small diameter portion of said piston when said piston is in a lower dead point are continuously formed on said cylinder; and wherein one or two or more pressure release grooves are disposed through a thickness direction in a surface of a sleeve by which the sleeve as the pressure resistant structure member contacts a fixing bolt.

36. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, and said piston is connected to a connecting rod by pressing a connecting flange portion extended to a rear end of said piston in a connection space formed in said connecting rod by a spring so that said piston can oscillate with respect to said connecting rod; and wherein one or two or more pressure release grooves are disposed through a thickness direction in a surface of a sleeve by which the sleeve as the pressure resistant structure member contacts a fixing bolt.

37. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, and a protrusion shape of a tip end of said piston and a shape of an inner surface of a cylinder head opposite to the tip end are formed in the same R shape; and wherein one or two or more pressure release grooves are disposed through a thickness direction in a surface of a sleeve by which the sleeve as the pressure resistant structure member contacts a fixing bolt.

38. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a labyrinth seal structure in which a plurality of labyrinth grooves are formed in a peripheral surface of said piston and no lubrication is performed between the peripheral surface of said piston and an operation inner surface of said cylinder, and for a relation between said piston and said cylinder, in a top dead point and a lower dead point in the reciprocating/driving of said piston, a tip end peripheral edge and a rear end peripheral edge of said piston are positioned not to enter the operation inner surface of said cylinder; and a plurality of reciprocating compression sections, for compressing the gas in multiple stages, wherein at least the reciprocating compression section of a first stage is provided with a first compression chamber and a second compression chamber, and a double compression structure of discharging the gas sucked and compressed in the first compression chamber to the second compression chamber and again compressing the gas and subsequently discharging and feeding the gas to the reciprocating compression section of the next stage is disposed.

39. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, a tip end small diameter portion is formed on said piston, and a small diameter compression section into which the tip end small diameter portion of said piston is inserted when said piston is in a top dead point, and a large diameter portion for forming a compression space in the periphery of the tip end small diameter portion of said piston when said piston is in a lower dead point are continuously formed on said cylinder; and a plurality of reciprocating compression sections, for compressing the gas in multiple stages, wherein at least the reciprocating compression section of a first stage is provided with a first compression chamber and a second compression chamber, and a double compression structure of discharging the gas sucked and compressed in the first compression chamber to the second compression chamber and again compressing the gas and subsequently discharging and feeding the gas to the reciprocating compression section of the next stage is disposed.

40. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, and said piston is connected to a connecting rod by pressing a connecting flange portion extended to a rear end of said piston in a connection space formed in said connecting rod by a spring so that said piston can oscillate with respect to said connecting rod; and a plurality of reciprocating compression sections, for compressing the gas in multiple stages, wherein at least the reciprocating compression section of a first stage is provided with a first compression chamber and a second compression chamber, and a double compression structure of discharging the gas sucked and compressed in the first compression chamber to the second compression chamber and again compressing the gas and subsequently discharging and feeding the gas to the reciprocating compression section of the next stage is disposed.

41. A high-pressure compressor provided with a compression mechanism for reciprocating/driving a piston with respect to a cylinder by rotation of a motor and compressing an operating fluid sucked by the driving to generate a high-pressure operating fluid, wherein said compression mechanism comprises a non-lubricating seal structure between an operation inner surface of said cylinder and said piston, and a protrusion shape of a tip end of said piston and a shape of an inner surface of a cylinder head opposite to the tip end are formed in the same R shape; and a plurality of reciprocating compression sections, for compressing the gas in multiple stages, wherein at least the reciprocating compression section of a first stage is provided with a first compression chamber and a second compression chamber, and a double compression structure of discharging the gas sucked and compressed in the first compression chamber to the second compression chamber and again compressing the gas and subsequently discharging and feeding the gas to the reciprocating compression section of the next stage is disposed.

* * * * *